US006079379A

United States Patent [19]

Cobb, Jr.

[11] Patent Number: 6,079,379

[45] Date of Patent: Jun. 27, 2000

[54] PNEUMATICALLY CONTROLLED COMPRESSED AIR ASSISTED FUEL INJECTION SYSTEM

[75] Inventor: William T. Cobb, Jr., St. Petersburg, Fla.

[73] Assignee: Design & Manufacturing Solutions, Inc., Lutz, Fla.

[21] Appl. No.: 09/065,374

[22] Filed: Apr. 23, 1998

[51] Int. Cl.[7] ..... F02B 33/04

[52] U.S. Cl. ..... 123/73 B

[58] Field of Search ..... 123/73 R, 73 B, 123/73 C, 73 S, 73 PP, 65 A, 531, 533; 417/379, 385

[56] References Cited

U.S. PATENT DOCUMENTS

| | | | |
|---|---|---|---|
| 3,263,701 | 8/1966 | Johnson | 137/533.17 |
| 3,265,050 | 8/1966 | Tuckey | 123/119 |
| 3,353,525 | 11/1967 | Nutten et al. | 123/119 |

(List continued on next page.)

FOREIGN PATENT DOCUMENTS

| | | |
|---|---|---|
| 0302045 | 2/1989 | European Pat. Off. . |
| 397695 | 6/1994 | European Pat. Off. . |
| 77105061 | 7/1988 | Japan . |
| WO 96/00843 | 1/1996 | WIPO . |
| WO 9607817 | 3/1996 | WIPO . |
| WO 97/02424 | 1/1997 | WIPO . |
| WO 97/22852 | 6/1997 | WIPO . |

OTHER PUBLICATIONS

Le Moteur A Deux–Temps, A Injection Electronique, Ingenieurs de L'automobile, Nov. 1977, 26 pages by Jaulmes et al., pp. 717–729, and 30 page translation of Ingenieurs de l'Automobile.

Development of A Pumpless Air Assisted Injection System for Two–cycle, S.I. Engines, R. Gentili et al., SAE, 1994, pp.

IAPAC Compressed Air Assisted Fuel Injection for High Efficiency Low Emissions Marine Outboard Two–Stroke Engines, G. Monnier et al., SAE Paper 911849, 1991, pp. 123–135.

Delayed Charging: A Means to Improve Two–Stroke Engine Characteristics, P. Rochelle, SAE Paper 941678, 1994, pp. 1–9.

The OCP Small Engine Fuel Injection System For Future Two–Stroke Marine Engines, S. Leighton et al., SAE Paper 941687, 1994, pp. 115–122.

Diaphragm Injection Carburettor (DIC) for Stratified–Scavenging of Small Two–Stroke Gasoline Engine, X. Yang et al., SAE Paper 960364, 1996, pp. 55–62.

Diaphragm Fuel Injection System (DFI) for Stratified–Scavenging of Small Two–Stoke Gasoline Engine, X. Yang et al., SAE Paper 960365, 1996, pp. 63–71.

Improving The Exhaust Emissions of Two–Stroke Engines by Applying the Activated Radical Combustion, Y. Ishibashi et al., SAE Paper 960742, 1996, pp. 113–123.

Pro–Ject Air–Assisted Fuel Injection System for Two–Stroke S.I. Engines, R. Gentili et al., SAE Paper 960360, pp. 1–6.

Application of Direct Air–Assisted Fuel Injection to a SI Cross–Scavenged Two–Stroke Engine, R. G. Kenny, et al., SAE Paper 932396, 1993, pp. 37–50.

(List continued on next page.)

*Primary Examiner*—Erick Solis
*Assistant Examiner*—Brian Hairston
*Attorney, Agent, or Firm*—Perman & Green, LLP

[57] ABSTRACT

A two-stroke internal combustion engine having a compressed air assisted fuel injection system. The injection system has an accumulator that uses scavenged air from the crankcase as the compressed air source. The injection system has a valve connected to an exit from the accumulator. The valve is connected to a diaphragm with two diaphragm pressure chambers on opposite sides of the diaphragm. Both diaphragm pressure chambers are connected to pressure in the crankcase; one of the diaphragm pressure chambers by a flow restrictor.

46 Claims, 24 Drawing Sheets

U.S. PATENT DOCUMENTS

| | | | |
|---|---|---|---|
| 3,441,010 | 4/1969 | Barr et al. | 123/119 |
| 3,633,557 | 1/1972 | Tuckey | 123/119 B |
| 3,640,512 | 2/1972 | Morgenroth | 261/34 A |
| 3,738,623 | 6/1973 | Tuckey | 261/35 |
| 3,743,254 | 7/1973 | Tuckey | 261/34 A |
| 3,765,657 | 10/1973 | Du Bois | 261/37 |
| 3,870,025 | 3/1975 | Anderson et al. | 123/139 AF |
| 3,933,949 | 1/1976 | Woody | 261/35 |
| 4,159,012 | 6/1979 | Pizzuto et al. | 123/65 R |
| 4,210,105 | 7/1980 | Nohira et al. | 123/277 |
| 4,455,266 | 6/1984 | Gerhardy | 261/35 |
| 4,627,390 | 12/1986 | Antoine | 123/531 |
| 4,628,881 | 12/1986 | Beck et al. | 123/447 |
| 4,628,888 | 12/1986 | Duret | 123/531 |
| 4,693,224 | 9/1987 | McKay | 123/531 |
| 4,700,668 | 10/1987 | Schierling et al. | 123/73 C |
| 4,716,877 | 1/1988 | Duret | 123/531 |
| 4,770,132 | 9/1988 | Sougawa | 123/73 A |
| 4,781,164 | 11/1988 | Seeber et al. | 123/533 |
| 4,794,902 | 1/1989 | McKay | 123/533 |
| 4,813,391 | 3/1989 | Geyer et al. | 123/73 C |
| 4,846,119 | 7/1989 | Geyer et al. | 123/73 C |
| 4,917,073 | 4/1990 | Duret | 123/73 C |
| 4,944,255 | 7/1990 | Duret | 123/65 EM |
| 4,995,349 | 2/1991 | Tuckey | 123/65 VB |
| 5,027,759 | 7/1991 | Luo | 123/73 PP |
| 5,027,765 | 7/1991 | Duret | 123/316 |
| 5,060,602 | 10/1991 | Maissant | 123/47 A |
| 5,105,775 | 4/1992 | Maissant | 123/70 R |
| 5,197,417 | 3/1993 | Tuckermann et al. | 123/73 C |
| 5,197,418 | 3/1993 | Wissmann et al. | 123/73 C |
| 5,203,310 | 4/1993 | Gatellier | 123/568 |
| 5,215,064 | 6/1993 | Monnier et al. | 123/532 |
| 5,273,004 | 12/1993 | Duret et al. | 123/73 V |
| 5,284,111 | 2/1994 | Geyer et al. | 123/73 C |
| 5,285,753 | 2/1994 | Duret et al. | 123/65 V |
| 5,351,668 | 10/1994 | Gatallier | 123/568 |
| 5,353,754 | 10/1994 | Wissmann et al. | 123/73 C |
| 5,365,893 | 11/1994 | Wissmann et al. | 123/73 C |
| 5,377,637 | 1/1995 | Leighton et al. | 123/73 AD |
| 5,377,650 | 1/1995 | Warner | 123/568 |
| 5,392,828 | 2/1995 | Watson et al. | 141/330 |
| 5,419,289 | 5/1995 | Duret et al. | 123/73 B |
| 5,438,968 | 8/1995 | Johnson et al. | 123/446 |
| 5,441,030 | 8/1995 | Satsukawa | 123/491 |
| 5,443,045 | 8/1995 | Marconi | 123/299 |
| 5,477,822 | 12/1995 | Haghgooie et al. | 123/286 |
| 5,477,833 | 12/1995 | Leighton | 123/497 |
| 5,483,943 | 1/1996 | Peters | 123/527 |
| 5,483,944 | 1/1996 | Leighton | 123/531 |
| 5,546,902 | 8/1996 | Paluch et al. | 123/304 |
| 5,551,638 | 9/1996 | Caley | 239/453 |
| 5,558,070 | 9/1996 | Bell et al. | 123/568 |
| 5,579,735 | 12/1996 | Todero et al. | 123/317 |
| 5,588,408 | 12/1996 | Kurihara | 123/196 W |
| 5,609,137 | 3/1997 | Rembold et al. | 123/531 |
| 5,622,155 | 4/1997 | Ellwood et al. | 123/568 |
| 5,628,295 | 5/1997 | Todero et al. | 123/568 |
| 5,645,026 | 7/1997 | Schlessmann | 123/184.46 |
| 5,685,273 | 11/1997 | Johnson et al. | 123/446 |
| 5,735,250 | 4/1998 | Rembold et al. | 123/73 C |
| 5,794,600 | 8/1998 | Hill | 123/531 |
| 5,809,949 | 9/1998 | Duret | 123/738 |

OTHER PUBLICATIONS

"The Orbital Combustion Procss for Future Small Two–Stroke Engines", S. Leighton et al., *A New Generation of Two–Stroke Engines for the Future?,* 1993, pp. 195–206.

New Developments for Clean Marine Outboard Two–Stroke Engines, P. Duret, *A New Generation of Two–Stroke Engines for the Future*?, 1993, pp. 125–145.

A Trial For Stabilizing Combustion in Two–Stroke Engines at Part Throttle Operation, Y. Ishibashi et al., *A New Generation of Two–Stroke Engines for the Future*?, 1993, pp. 113–124.

"IAPAC Two–Stroke Engine for High Efficiency Low Emissions Scooters", G. Monner et al., *A New Generation of Two–Stroke Engines for the Future*?, 1993, pp. 101–111.

"The IAPAC FLuid Dynamically Controlled Automotive Two–Stroke Combustion Process", P. Duret et al., *A New Generation of Two–Stroke Engines for the Future*?, 1993, pp. 77–98.

SAE Technical Paper Series, "Development of a Fuel Injected Two–Stroke Gasoline Engine", D. Plohberger et al., Paper No. 880170, 1988, 17 pages.

"Recent Research Activities on Small Diesel and Gasoline Engines", K. Landfahrer, C372/018, 5 pages.

Advertisement, "AVL ADIS, Semi Direct Injection System", AVL List Gmbh, 1 page.

SCIP: A New Simplified Camless IAPAC Direct Injection for Low Emission Small Two–Stroke Engines, J. Dabadie, SAE Paper, 10 pages.

"Emission and Fuel Consumption Reduction in a Two–Stroke Engine Using Delayed–Charging" by Rochelle, SAE Paper 951784, 1995, pp. 217–226.

RedMax Scores With Air head Engine, Power Equipment Trade, Jul. 1998, p. 74.

"Tanaka Meets CARB Tier II With PureFire Engine" By Ken Morrision, Power Equipment Trade, Jul. 1998, pp. 16–22 and 116.

PNEUMATICALLY CONTROLLED COMPRESSED AIR ASSISTED FUEL INJECTION SYSTEM

BACKGROUND OF THE INVENTION

1. Field of the Invention

The present invention relates to fuel injection systems for internal combustion engines and, more specifically, to a pneumatically controlled system for a two-stroke engine.

2. Prior Art

IAPAC direct fuel injection systems which use a cam to control introduction of scavenged compressed air from a crankcase have been used in the past to reduce pollutant emissions and fuel consumption in two-stroke engines. European Patent Office patent publication No. EP 0789138 discloses a camless IAPAC system (now known as SCIP) which uses a diaphragm connected to a valve, a spring, pressure from the engine crankcase, and pressure from combustion expansion gases in the combustion chamber to delay movement of the valve.

A problem exists with the cam driven IAPAC system in that added components increase cost to the engine. A problem exists with the SCIP system in that misfires in the combustion chamber result in no combustion expansion gases to delay movement of the valve. Misfires in a two-stroke engine can happen as often as one out of every three piston cycles. Thus, injection of fuel and air into the combustion chamber using a SCIP system can result in a substantial number of premature injections; about one-third of the time.

Several alternatives for the pressurized air utilized in the injection are known; a separate air pump may be utilized, the air source may be derived from the cylinder of the engine during the compression or the expansion stroke, or the air may be derived from the crankcase pumping of the engine. In low cost applications it is desired to utilize the air source from the crankcase or the cylinder, so as to avoid the added cost and complexity of the separate air pump. In the application of pneumatic injection to larger cylinder sized engines, in general larger than 50 cc displacement, it is generally desirable to utilize injection pressure derived from the cylinder pressure because a high gas pressure may be obtained for injection. In smaller engines this tapping utilizes a disproportionate quantity of the cylinder charge gases and, thus, adversely affects the performance of the engine. It is therefore more practical to utilize the crankcase pumping source in such cases.

It is most beneficial to inject the fuel into the cylinder near to or slightly after the bottom dead center position of the piston. This injection timing avoids introducing the fuel into the early phase of the cylinder scavenging, and thus avoiding short circuit loss to the exhaust. Further, the fuel is introduced into the cylinder when the pressure in the cylinder in near atmospheric pressure, allowing the best use of the limited injection pressure to spray and therefore atomize the fuel charge. Thus, it is desirable to have a pneumatic injection timing near to the bottom dead center timing of the piston and that this timing be relatively constant with changing engine operational parameters such as speed and throttle position or load.

Several methods for operating an injection valve are taught in the prior art. U.S. Pat. No. 4,693,224 teaches the use of an electronic solenoid to operate the injection valve. This is generally unacceptable for application to small high speed engines because of the necessity of an engine control unit to operate the valve and the relatively high power requirement to drive the high speed solenoid, both adding prohibitive costs to the engine. The most common method of operating the valve as taught by the prior art is the use of some form of kinematic valve linkage driven from the crank shaft of the engine. These valves take the form of oscillating valves driven by cams as taught by a system called "PROJECT" described in an article "Pro-Ject Air-Assisted Fuel Injection System For Two-Stroke Engines", SAE 940397 from Universita di Pisa and a system from L'Institut Francais du Petrole described in an article "A New Two-Stroke Engine With Compressed Air Assisted Fuel Injection For High Efficiency Low Emissions Applications" by Duret et al. in SAE 880176, or rotating type valves as taught by Honda in an article "An Experimental Study of Stratified Scavenging Activated Radical Combustion Engine" by Ishibashi, SAE 972077. A problem exists with all the forms of kinematically driven valves in that they need precision surfaces and high quality materials for both the sealing members of the valve and the running portions of the drive. Valves mounted such that they are exposed to combustion gases must also be fashioned from expensive heat resistant materials. Additionally, many parts require lubrication which is not presently available in the simple two-stroke engine. Thus, the mechanical type valve arrangements add significant costs and complexity to the construction of the engine. Therefore, it is desirable to fashion an injection control valve that may be made of inexpensive materials and need not be manufactured to high tolerance, the valve and drive mechanism most preferably would require no high temperature capability or additional lubrication.

Further, an additional problem is commonly known to exist in the application of oscillating valves to high speed engines. The problem is that of the greatly increasing drive force required as the engine speed increases. For a fixed valve opening amplitude or lift, the acceleration required of the valve increases in proportion to the square of the valve opening frequency and therefore the engine speed. Further, the force required to drive the valve in creases in proportion to the acceleration. Thus, the force required to drive the valve increases in proportion to the square of the engine speed. For single acting valve trains, that is valves actively driven in only one direction, these high drive forces lead to the use of large return springs to over come the valve inertial forces and prevent valve float, and consequently even more elevated drive forces. It is desirable to drive the valve in both directions, both open and closed, to avoid the use of large spring members and the associated high forces, while still attaining high speed operation. Mechanical means can be applied to drive the valve in both directions, however, this requires an even higher degree of precision and leads to even greater cost and complexity of the engine.

The final method of driving the injection valve is to operate the valve pneumatically. Pneumatic operation is affected by driving a piston through the use of a differential gas pressure across the two opposing faces of the piston. This piston in turn drives the valve. The use of pneumatic operation is common practice in gas flow control, in such devices as flow regulators and flow control valves such as spool valves. In engine operation pneumatically controlled valves are commonly utilized in carburetor operation for flow control, regulation of pressures and various operations such as driving liquid injections and opening addition flow paths. Examples of such use are shown in U.S. Pat. Nos. 5,377,637; 5,353,754; 5,197,417; 5,197,418; 4,846,119 and 4,813,391. In their application to engines where limited motion is required the piston is often in the form of a diaphragm, acting as the piston seal, and diaphragm plates functioning as the drive piston.

The use of pneumatic valve operation for control of a pneumatic injection system is taught in WO 96/07817 and EP 0789138A1. These systems utilize an injection valve placed in the head of the combustion chamber and operated on by pressures derived from various locations of the engine to influence the valve motion.

WO 96/07817 teaches a pneumatic valve that is opened when the injection pressure as derived from the crankcase of the engine overcomes the pressure from the valve closing spring and a delayed pressure wave derived from the crankcase. A problem exists in such a system that the injection pressure as derived from the crankcase is highly dependent on the engine operating condition. The peak pressure attained by the crankcase in a small two stroke engine varies with the throttle position. At wide open throttle (WOT) the peak pressure may reach 6 to 7 pounds per square inch above atmospheric pressure (psig), while at low throttle opening the peak pressure only reaches 1.5 to 2 psig. Thus the injection pressure available to open the valve is highly dependent on operating condition and thus, the injection timing is dependent on operating conditions. Further, in a small high speed engine the area of the valve is severely limited by the available space in the engine. This small area and the relatively low injection pressure available to act on that area lead to a small available force for valve opening. This coupled with the previously mentioned phenomenon of the required high force at high speed severely limit the use in the small high speed application. Thus it is desirable to have a valve actuation system that is largely independent of injection pressure, further it is desired that the primary motive force be derived from the diaphragm or drive piston such that the valve operation is largely independent of valve area.

A further problem exists with WO 96/07817. The wave used to control the injection is derived from the crankcase pressure through a long 'delay' line. The delay line is used to control the time of arrival of the pressure wave at the valve. The transit time in seconds of the pressure wave is fairly constant, however the transit and arrival timing in terms of crankshaft position, and therefore piston position, is highly dependent on engine speed. Thus, the injection timing is highly dependent on engine speed. Further the delay line also acts to attenuate the pressure wave, this attenuation is more acute with increasing engine speed. The attenuation coupled with the relatively weak crankcase wave render an inadequate control pressure in high speed/high load operation. It is desired to fashion a valve control system that is largely independent of engine speed.

Other embodiments of the art teach the use of controlling crank 'cheeks' and additional delay lines to further. control the pressure waves. These controlling cheeks must be made as precision valve surfaces to control the small flows associated with the valve control and thus add significant cost to the engine. The additional delay lines impart further speed dependence on the injection timing.

These deficiencies in WO 96/07817 are also pointed out in EP 0789138A1. EP 0789139A1 teaches the use of a valve as in the previous patent where the wave utilized to delay the injection is derived from the cylinder expansion gases. The expansion wave is again delivered to the valve control diaphragm through a delay line. In some embodiments the opening force available is enhanced by the use of longer delay lines from either the cylinder expansion gases or the crankcase wave and is delivered to the opposite side of the actuating diaphragm. Although this embodiment does enhance the opening force and improve on the problem of low pressure of the crankcase wave, the deficiency of the injection timing being highly dependent on engine speed is further introduced. Thus the injection behavior may only be optimized for a specific engine speed.

A further and critical problem is introduced through the use of the expansion gases to control the valve motion. Small two-stroke engines mostly exhibit poor combustion characteristics with misfire or partial combustion occurring every couple of strokes. During misfire there are no combustion expansion gases to be utilized to delay the injection. Further, due to ring seal leakage, the pressure during the late stages of the normal expansion stroke after misfire is often sub-atmospheric, thus further advancing the injection timing. Therefore, as often as every third stroke the injection occurs at, or before, the beginning of the fresh air scavenging of the cylinder, thereby short circuiting both the unburned charge from the misfired stroke and a large portion of the early injected charge for the following stroke. It is therefore desirable to fashion an injection control system that is largely independent of combustion expansion gases from combustion of an individual piston cycle.

In both of the aforementioned publications the primary motive force for the closure of the valve is a spring positioned in the diaphragm chamber. This spring must be of sufficiently low force to allow the valve to be opened by the low injection pressures or diaphragm drive forces available. This low force combined with the increasing inertial forces of the valve at high speed lead to later and later valve closure and eventually valve float. Again it is desirable to fashion a double acting valve drive system that drives the valve both open and closed in a positive way.

A normal feature of small two-stroke engines is the lack of a separate lubrication system. The lubricant is commonly delivered to the crankcase components and the piston-cylinder unit through being mixed with the fuel. In direct injected engines, including pneumatically injected engine, of the prior art the fuel with no lubricant is delivered to the combustion chamber. This requires the addition of a separate lubrication supply pump and system for the crankcase and piston-cylinder unit, thus adding cost and complexity to the engine. It is therefore desirable to have the injection system supply a limited but significant quantity of fuel oil mixture to the crankcase to meet the engine lubrication requirement with limited additional complexity or cost.

It is an object of the present invention to have a double acting valve that is positively driven towards both the open and closed position.

It is an object of the present invention to have a valve that operates largely independently of injection pressure.

It is an object of the present invention to have a valve timing that is largely independent of operational conditions of the engine, specifically speed influences and throttle position/load influences.

It is an object of the present invention to provide a valve that is predominantly open, thereby providing lubrication without additional systems.

It is an object of the present invention to fashion a valve and drive that does not require the use of high temperature capable materials.

It is an object of the present invention to fashion a valve and drive that may be manufactured by presently utilized techniques and materials of the mass production industry.

It is an object of the present invention to provide a valve not requiring precision ground sealing surfaces.

SUMMARY OF THE INVENTION

In accordance with one embodiment of the present invention an internal combustion engine is provided comprising a pneumatically controlled compressed air assisted fuel injection system. The injection system has a valve connected to a diaphragm. Two diaphragm chambers are located on opposite sides of the diaphragm. Both of the diaphragm chambers are connected to pressure from a crankcase of the engine. A second one of the diaphragm chambers is connected to the crankcase pressure through a flow restrictor. Pressure in the second diaphragm chamber is thus an attenuated averaged pressure relative to the crankcase pressure.

In accordance with one method of the present invention, a method of determining timing of movement of a valve in a pneumatically controlled compressed air assisted fuel injection system for an internal combustion engine is provided. The method comprises steps of sensing pressure inside a crankcase of the engine; determining when crankcase blowdown has substantially completed based upon the sensed pressure inside the crankcase; and allowing movement of the valve to an open position only after substantial completion of crankcase blowdown has been determined.

In accordance with another embodiment of the present invention, a two-stroke internal combustion engine is provided comprising a pneumatically controlled compressed air assisted fuel injection system. The injection system has a source of compressed air and a valve connected to an exit from the source of compressed air. The injection system further comprises means for maintaining the valve in an open position during a rotation of a crankshaft of the engine of about 270° to about 220°.

In accordance with another embodiment of the present invention a two-stroke internal combustion engine is provided comprising an engine displacement size of between about 16 cc to about 38 cc, a low pressure fuel metering system, and a pneumatically controlled compressed air assisted fuel injection system connecting the fuel metering system to a cylinder of the engine. The injection system is adapted to inject air and fuel at a timing such that operating hydrocarbon emissions from the engine are less than 50 gm/bhp*hr.

In accordance with another embodiment of the present invention an internal combustion engine is provided comprising a pneumatically controlled compressed air assisted fuel injection system. The injection system has a valve connected to a diaphragm across a first diaphragm pressure chamber. The first diaphragm pressure chamber is in communication with a crankcase of the engine such that crankcase pressure is provided to the diaphragm pressure chamber. Pressure in the diaphragm pressure chamber both pushes on the diaphragm to locate the valve at a closed position and pulls on the diaphragm to locate the valve at an open position as crankcase pressure varies.

In accordance with another embodiment of the present invention an internal combustion engine is provided having a pneumatically controlled compressed air assisted fuel injection system. The injection system has a valve connected to a diaphragm and two diaphragm chambers on opposite sides of the diaphragm. The diaphragm chambers are connected to at least one location of the engine that generates varying gas pressures substantially separate and independent of combustion expansion gases from combustion in an individual piston cycle.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
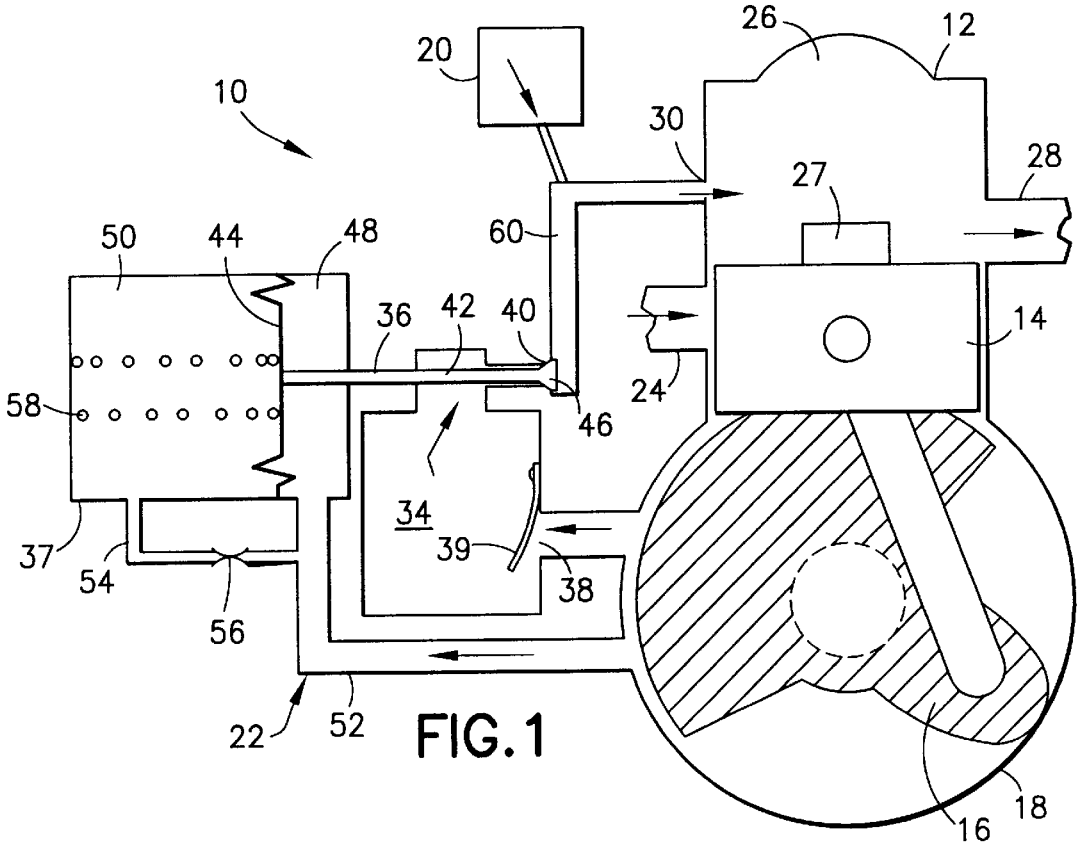
FIG. 1 is a schematic view of an internal combustion engine incorporating features of the present invention.

Referring to FIG. 1, there is shown a schematic view of an internal combustion engine 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The engine 10 is a two-stroke engine having a cylinder 12, a piston 14, a crankshaft 16, a crankcase 18, a fuel metering system 20, and a fuel injection system 22. The present invention relates to the control of a low pressure pneumatic injection of an internal combustion engine. A particular field of application of the invention is a two-stroke internal combustion engine. The specific application described is to a small high speed two-stroke engine, such as utilized in handheld power equipment such as leaf blowers, string trimmers and hedge trimmers, also in wheeled vehicle applications such as mopeds, motorcycles and scooters and in small outboard boat engines. The small two stroke engine has many desirable characteristics, that lend themselves to the above applications, including: simplicity of construction, low cost of manufacture, high power-to-weight ratios, high speed operational capability and, in many parts of the world, ease of maintenance with simple facilities.

Figure 1A:
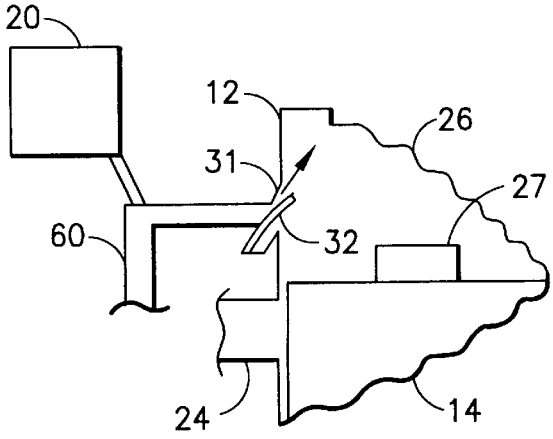
FIG. 1A is a partial schematic view of an alternate embodiment of the engine shown in FIG. 1.

The prominent draw back of the simple two-stroke engine is the loss of a portion of the fresh unburned fuel charge from the cylinder during the scavenging process. This leads to poor fuel economy and, most importantly, high emission of unburned hydrocarbon, thus rendering the simple two-stroke engine incapable of compliance with increasingly stringent governmental pollution restrictions. This draw back is typically relieved by separating the scavenging of the cylinder, with fresh air, from the charging of the cylinder, with fuel. This separation can be achieved by injecting the liquid fuel into the cylinder or more preferably by pneumatically injecting the fuel charge by utilizing a pressurized air source, separate from the fresh air scavenge, to spray the fuel into the cylinder. In a preferred embodiment the displacement size of the engine is about 16 cc to about 100 cc, but could be larger or smaller. These sizes of engines are used for such things as string trimmers, chain saws, leaf blowers, and other hand held power tools. The engine could also be used on a tool such as a lawn mower, snow blower or motor boat outboard engine. The cylinder 12 has a spark plug (not shown) connected to its top, a bottom connected to the crankcase 18, an air inlet 24, a combustion chamber 26, an exhaust outlet 28, and a fuel inlet 30 into the combustion chamber. The fuel metering system 20 could be any suitable type of system, such as a carburator or electronic fuel injector. However, an advantage of the present system is that there is no need for high precision timing or spray quality for the fuel metering system. A relatively simple metering system that delivers drops of fuel could be used. In the embodiment shown in FIG. 1A the fuel inlet 30 is open; i.e.: with no flow check valve into the combustion chamber 26. However, an alternate embodiment is shown in FIG. 1A which has a flow check valve at its fuel inlet. In this alternate embodiment the fuel inlet 31 has a reed valve 32 that functions as the check valve, but any suitable check valve could be used. The inlet 31 is located in a side wall of the cylinder 12 and is shaped to input fuel and air in an upward direction towards the top of the cylinder head. However, in alternate embodiments the inlet could be located in the top of the cylinder head or be shaped to direct fuel towards the top of the piston 14.

Referring back to FIG. 1, the fuel injection system 22 is a compressed air assisted system. The injection system 22 comprises an accumulator 34, a diaphragm and valve assembly 36, and a housing 37. The accumulator 34, in this embodiment, has an inlet 38 connected to pressure inside the crankcase 18 and an exit 40. The accumulator 34 functions as a collector and temporary storage area for compressed air. In this embodiment the source of the compressed air is air scavenged from the crankcase 18. The piston 14 compresses the air in the crankcase 18 on the piston's downward stroke. A reed valve 39 is provided at the inlet 38 to allow scavenged air to flow in only one direction through the inlet. However, any suitable flow check valve could be used. The diaphragm and valve assembly 36 comprises a valve 42 and a diaphragm 44. The valve 42 has a valve head 46 that is longitudinally movable to open and close the accumulator exit 40. The diaphragm 44 has the valve 42 connected thereto and establishes two diaphragm pressure chambers 48, 50 formed in the housing 37 on opposite sides of the diaphragm 44. Conduits or channels 52, 54 lead through the housing 37 from the crankcase 18 to the chambers 48, 50. A flow restrictor 56 is provided in the channel 54 to the outer chamber 50. In a preferred embodiment the restrictor 56 merely comprises a narrowed hole. However, any suitable type of flow restrictor to delay flow of air therethrough could be provided. The valve 42 extends from the diaphragm 44 across the inner chamber 48 to the accumulator exit 40. A spring 58 is provided in the outer chamber 50 to bias the diaphragm towards the inner chamber 48. Because the valve 42 is connected to the diaphragm 44, this biases the valve 42 towards an open position with the valve head 46 in an open spaced position at the exit 40. In an alternate embodiment the spring could be located in the inner chamber 48. In another embodiment no spring need be provided. A channel 60 extends from the exit 40 to the fuel inlet 30. The fuel metering system 20 is connected to the channel 60 to insert fuel into the channel 60 which is subsequently mixed with a pressure pulse of air from the accumulator 34 and injected into the combustion chamber 26 through the inlet 30.

Figure 2:
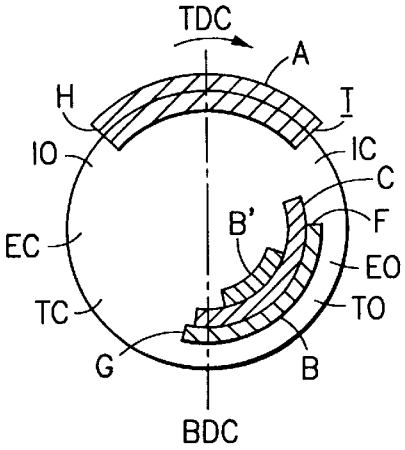
FIG. 2 is a diagram illustrating valve position and fuel inlet piston porting relative to piston location based upon crankshaft rotation.

Referring also to FIG. 2, opening and closing of the valve 42 relative to other events during a single full piston cycle (which results from a 360° rotation of the crankshaft 16) will be described. FIG. 2 is intended to illustrate the line of events as a 360° chart corresponding to piston location as based upon angular position of the crankshaft 16 starting at top dead center (TDC) position of the piston 14. At TDC the valve inlet 30 is blocked by the side of the piston head. Area A indicates when the piston head blocks the inlet 30. The piston head uncovers the inlet 30 at about 45° of rotation of the crankshaft after TDC (ATDC). Shortly after this the air inlet 24 is closed by the piston head at point IC. Area B indicates when the valve 42 is moved to a closed position by the diaphragm 44 in an engine at 3200 RPM at wide open throttle (WOT). From TDC to about 90° after TDC the valve 42 is at an open position. The valve 42 is moved to its closed position by pressure of gases in the crankcase 18. The valve 42 is kept closed until about 10° after bottom dead center (BDC). The valve 42 then remains in its open position as the piston moves back up to TDC. At about 45° before TDC (BTDC) the head of the piston 14 closes the inlet 30 again as indicated by H in area A. EO indicates when the head of the piston 14 moves down enough to open the combustion chamber to the exhaust outlet 28. TO indicates when the head of the piston moves down enough to open access from the combustion chamber to the transfer channel 27. TC indicates when the transfer channel 27 is closed by the head of the piston as the piston head moves back up. EC indicates when the exhaust outlet 28 is closed by the head of the piston. IO indicates when the air intake 24 is opened to the crankcase as the head of the piston moves towards TDC. With this embodiment the valve 42 is located at its open position for about 260° of rotation of the crankshaft. The valve 42 is located at its closed position for about 100° of rotation of the crankshaft; between about 90° after TDC to about 10° after BDC. Area B' shows the closed position for the valve 42 at an idle position of the engine if the pressure in chamber 50 was not provided. The valve 42 closes at about 115° after TDC and opens again at about 165° after TDC. Area C shows the closed position for the valve 42 when the fuel inlet has a check valve as indicated by the reed valve 39 at induction inlet 38. Area B shows the closed position of the valve 42 for an embodiment without the reed valve 39. Preferably, the system is adapted to keep the valve in its open position during a period of time corresponding to about 220° to about 270° of rotation of the crankshaft.

Figure 3A:
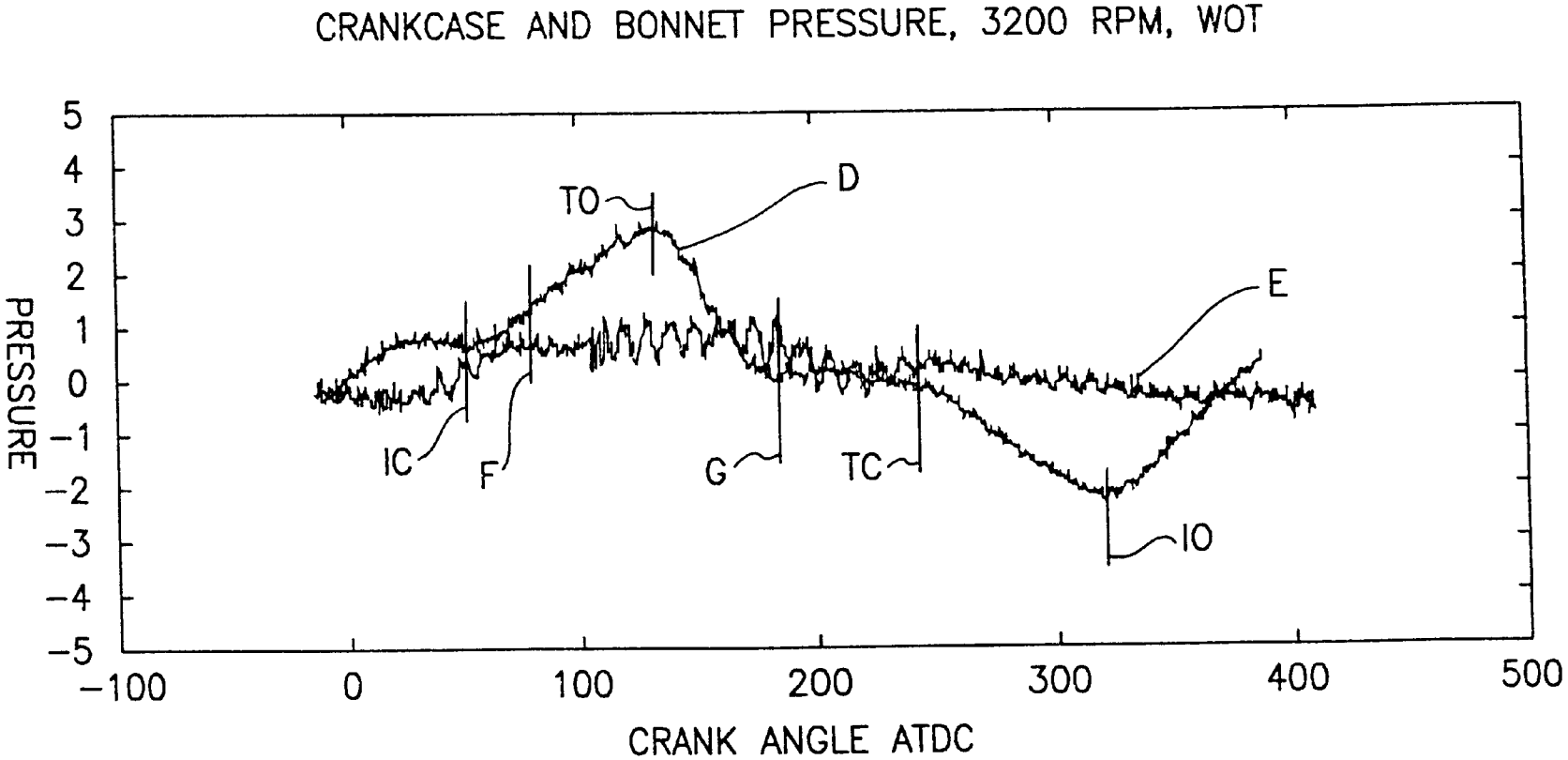
FIG. 3A is a graph of pressures in the two diaphragm pressure chambers shown in FIG. 1 at a first engine speed at wide open throttle.

Referring also to FIG. 3A, the pressures inside the two diaphragm pressure chambers 48, 50 will be discussed for a wide open throttle (WOT) at 3200 RPM relative to crank angle after TDC. These sample pressures were taken for a system as illustrated in FIG. 1 without the reed valve 32; i.e.: the piston ported embodiment with the valve closure as indicated by area B in FIG. 2. Line D illustrates the pressure in chamber 48. Line E illustrates the pressure in chamber 50. The pressure D in the inner chamber 48 is substantially the same as the pressure inside the crankcase 18. The left side of the chart is gage pressure measured in pounds per square inch (psi) and 0 (zero) in the chart represents atmospheric pressure. The pressure D varies between about 3 psi above and below atmospheric pressure. The pressure E varies between about 1 psi above and below atmospheric pressure. The flow restrictor is sized and shaped to provide the pressure E with a minimum attenuation of about one-third of the crankcase pressure. However, other ratios could be provided. The pressure in the crankcase 18 changes based upon opening and closing of the air inlet 24 by the head of the piston 14 and by the head of the piston compressing the air inside the crankcase 18 on its downward stroke. As seen in FIG. 3A, when the air inlet 24 is closed by the head of the piston 14 at IC (about 50° ATDC) pressure D in the inner chamber 48 increases. At about 130° ATDC the transfer channel 27 opens (TO). Thus, pressure in the crankcase and pressure D drops to atmospheric pressure until the transfer channel 27 closes again (TC) at about 240° ATDC. Pressure in the crankcase and pressure D then drops below atmospheric pressure, because of vacuum created by the upward movement of the piston head, until the air intake 24 opens (IO). Pressure in the crankcase and pressure D then rises.

Figure 4A:
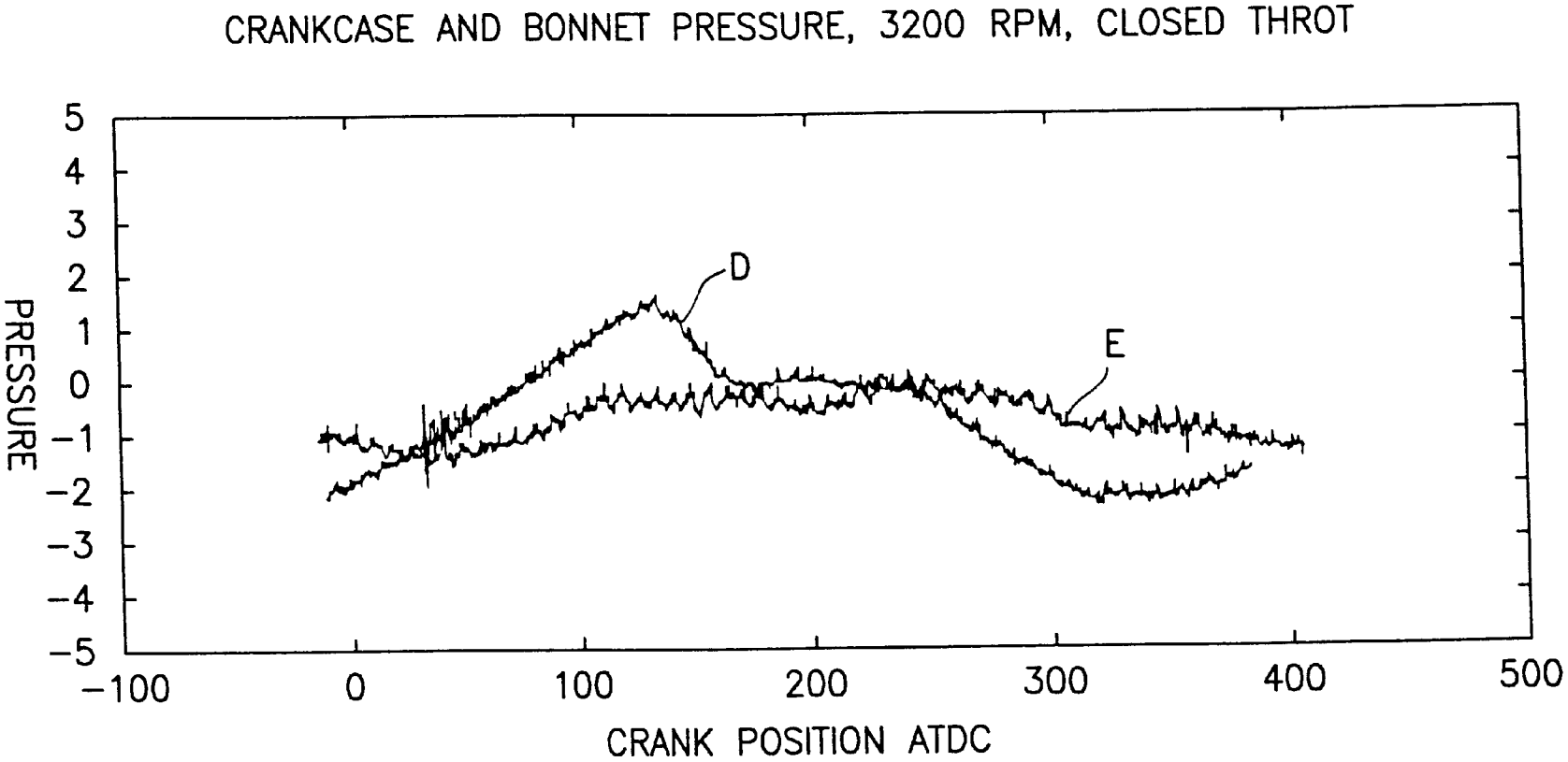
FIG. 4A is a graph of pressures in the two diaphragm pressure chambers as in FIG. 3A at a closed throttle.
Figure 4B:
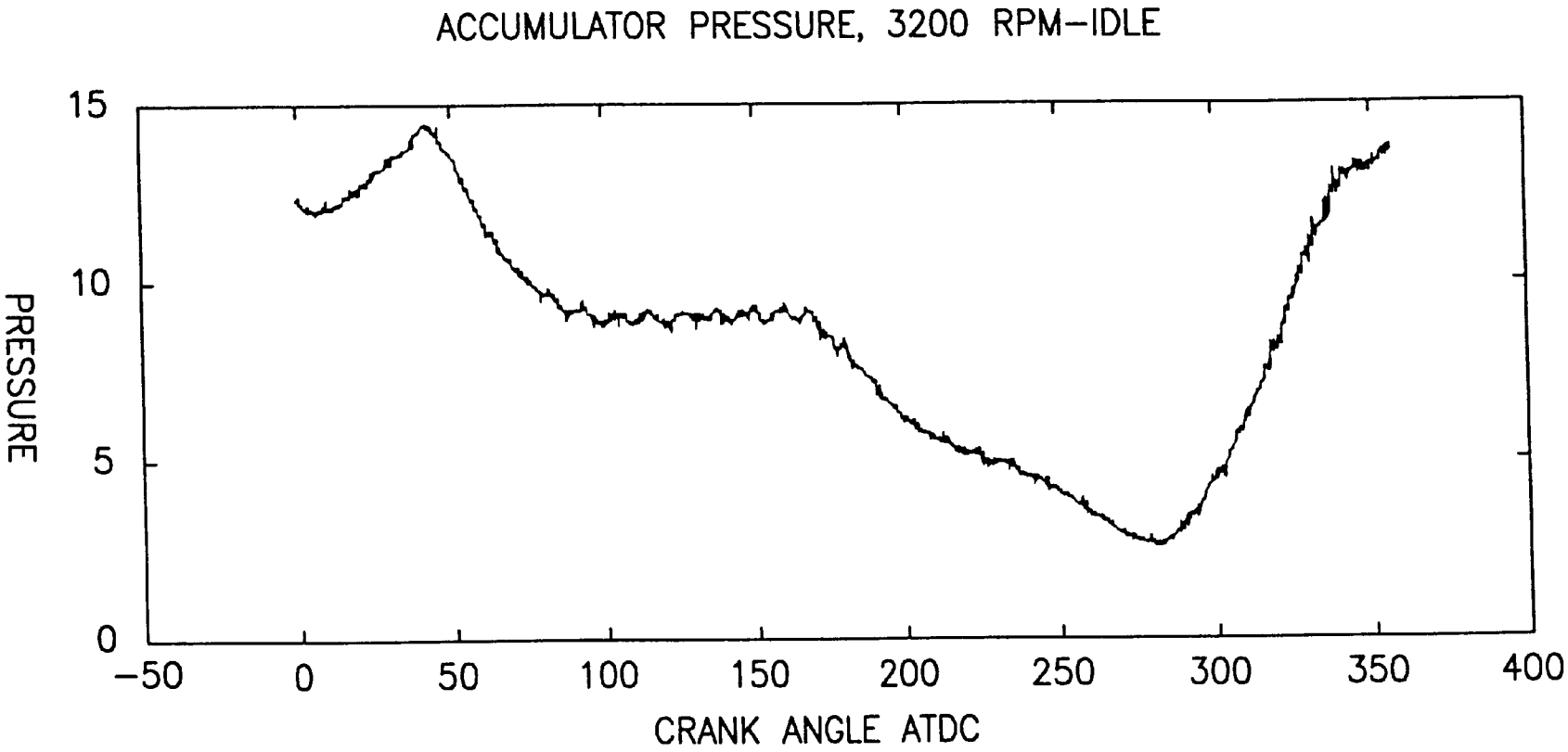
FIG. 4B is a graph of pressure in the accumulator as in FIG. 3B at a closed throttle.
Figure 5A:
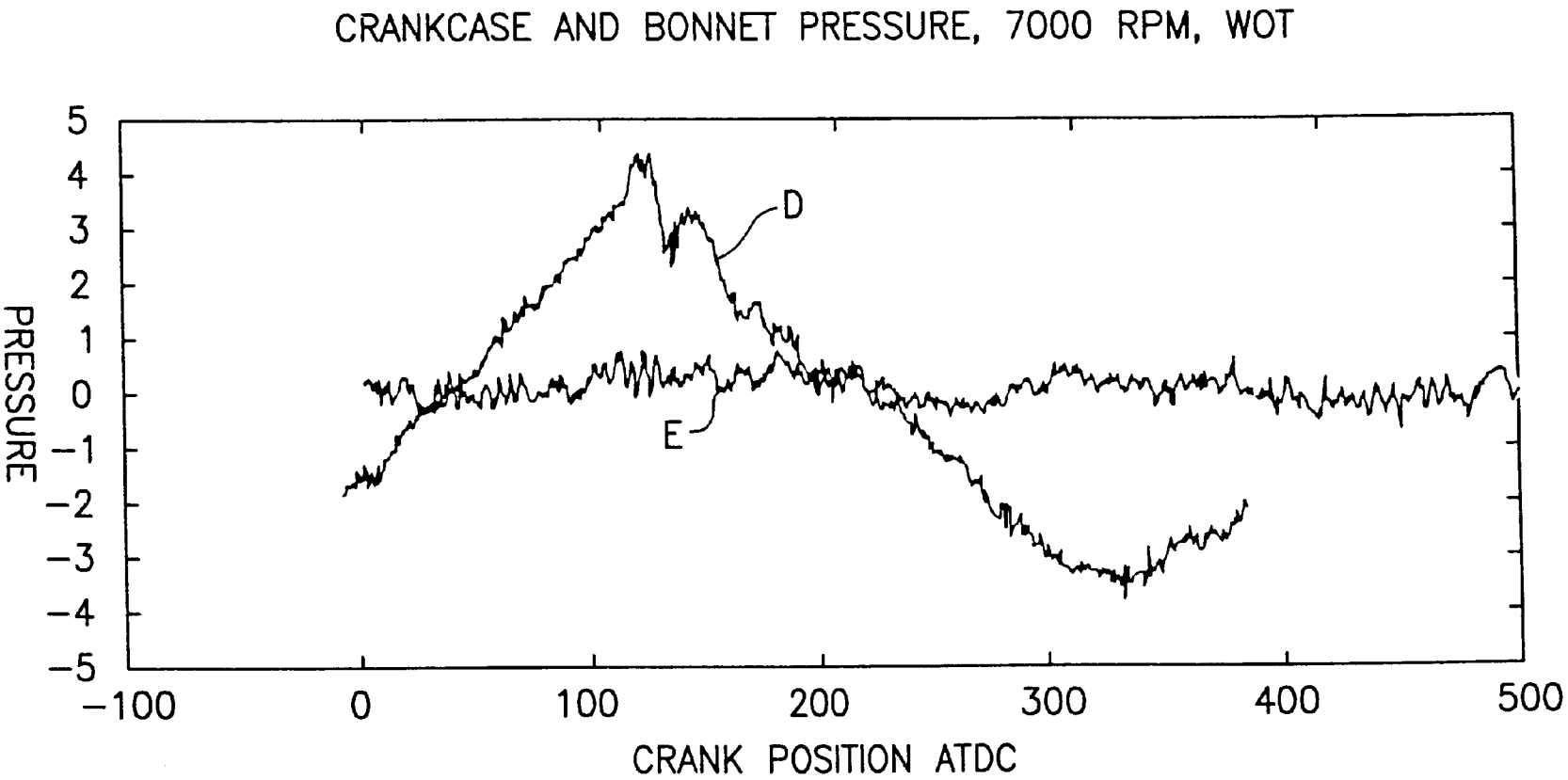
FIG. 5A is a graph of pressures in the two diaphragm pressure chambers shown in FIG. 1 at a second higher engine speed at wide open throttle.
Figure 5B:
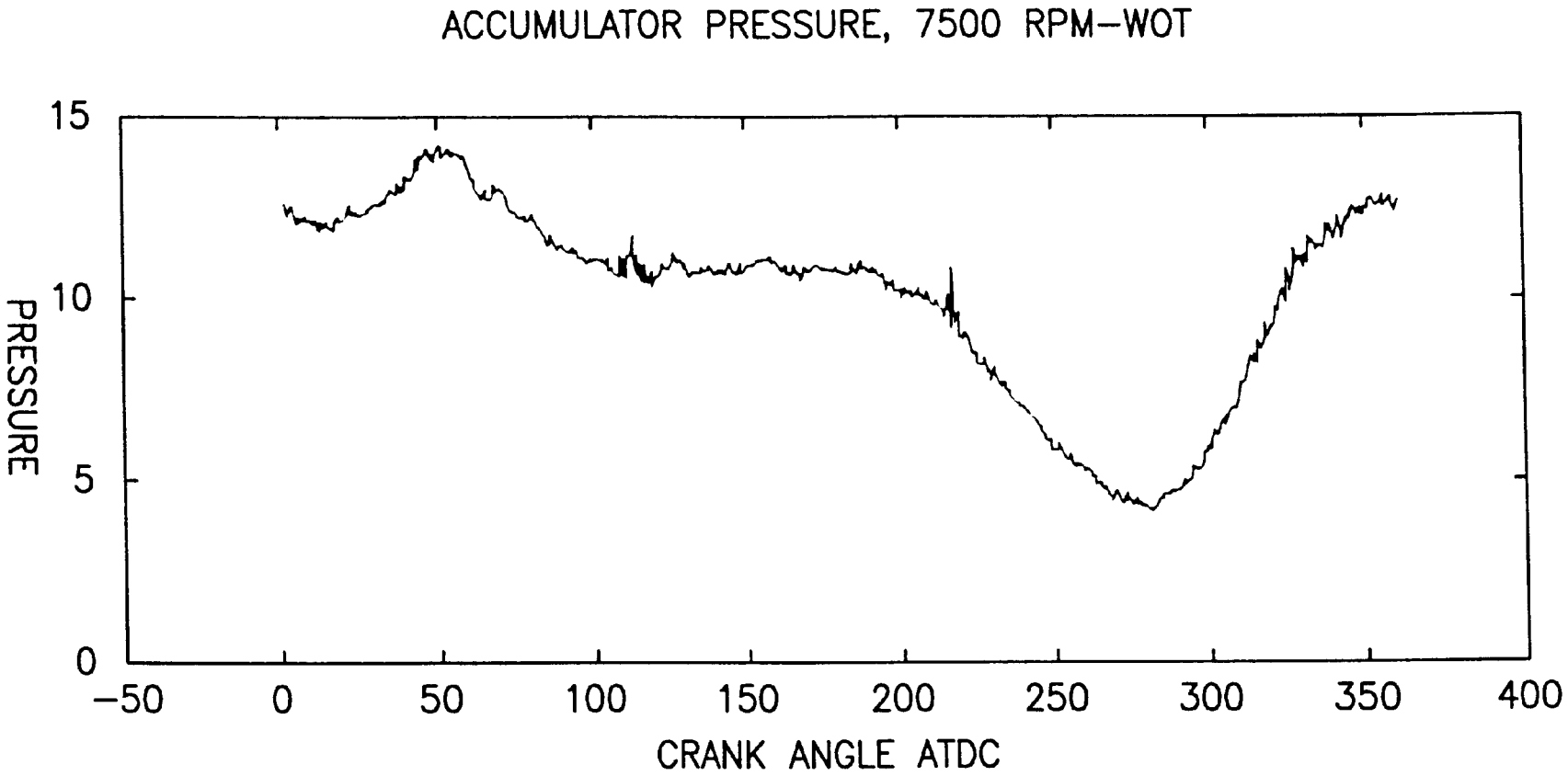
FIG. 5B is a graph of pressure in the accumulator shown in FIG. 1 at the second higher engine speed at wide open throttle.

Pressure E in the outer diaphragm pressure chamber 50, even though also in communication with pressure from the crankcase 18, is very different from the pressure D. As noted above, outer chamber 50 is connected to pressure from the crankcase 18 by the flow restrictor 56. The flow restrictor functions to attenuate and phase shift pressure D and average it to provide a more uniform pressure. Thus, where. pressure D can fluctuate greatly between TO and IO, the pressure E varies much less. However, pressure E still varies based upon crankcase pressure. Crankcase pressure can vary based upon atmospheric pressure variations, speed of the engine (RPMs), and throttle position. FIGS. 4A and 4B show the pressures D and E and the accumulator pressure for 3200 RPM at a closed throttle. FIGS. 5A and 5B show the pressures D and E and the accumulator pressure for 7500 RPM at a wide open throttle. Pressure E is thus dynamically variable as an attenuated, phase shifted, average of the crankcase pressure. These two pressures D, E, which are both driven and formed by crankcase pressure, determine when the valve 42 should be moved between open and closed positions and drive the valve's movement. The timing of the valve's movement to an open position is preferably based upon when crankcase blowdown is completed. More specifically, the injection system preferably allows the valve to move from a closed position to an open position only upon a sensed crankcase pressure indicating a substantial completion or full completion of crankcase blowdown. In an alternate embodiment an electronic sensor could sense pressure inside the crankcase and, when crankcase blowdown had been determined by this sensed pressure, the valve would then be allowed to move to its open position; after substantial or full completion of crankcase blowdown had been determined. Crankcase blowdown is completed at about BDC when the piston stops its downward movement which stops the pushing of air out of the crankcase 18 by the piston 14. Thus, the fuel injection system 22 opens the valve 42 at point G close to when crankcase blowdown is completed. By basing operation of the fuel injection system upon completion of crankcase blowdown, timing of the valve opening and closing does not change significantly at speed variations.

Figure 3B:
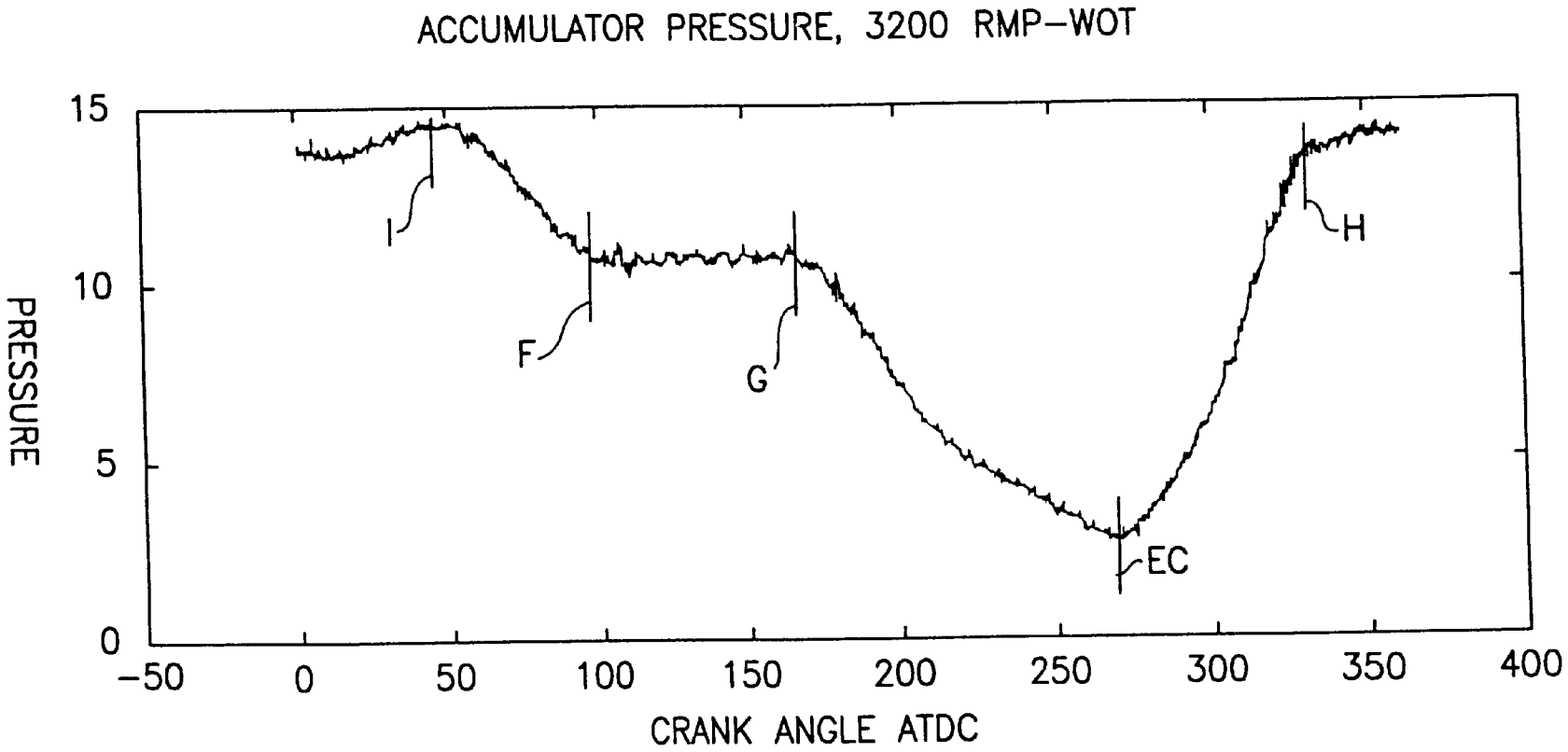
FIG. 3B is a graph of pressure in the accumulator shown in FIG. 1 at the first engine speed at wide open throttle.

Referring back to FIGS. 1, 2, 3A and 3B, at TDC (0°) the two pressures are about the same. However, because the spring 58 has been provided, the valve 42 would be biased at its open position. At point F (about 90° after TDC) the pressure in the inner chamber 48 is sufficiently greater than the pressure in the outer chamber 50 to overcome the spring 58 and move the diaphragm rearward. This moves the valve 42 to seat the head 46 in the accumulation exit 40 and thereby close the exit 40. FIG. 3B is a graph of corresponding pressure in the accumulator 34 measured in pounds per square inch (psi) above atmospheric pressure (i.e.: 0 (zero) in the left hand side of the chart represents atmospheric pressure). Pressure in the accumulator 34 in this piston ported system is greatest at area A between points H and I shown in FIG. 2 (between about 45° BTDC–45° ATDC) because compressed gases from the piston moving upward towards TDC exert pressure through the open inlet 30 and into the accumulator. The open inlet 30 is then piston ported to a closed position as the head of the piston 14 covers the inlet 30. Thus, the pressure in the accumulator 34 remains substantially the same between about 45° BTDC and about 45° ATDC. The pressure in the accumulator 34 drops when fuel inlet 30 is opened at 45° ATDC until point F at about 90° ATDC. At F the valve 42 is closed by pressure differences in the chambers 48, 50 as indicated above. Pressure in the accumulator 34 then remains about the same until point G at about 190° ATDC. Point G is when the crankcase pressure and pressure in chamber 48 decreases sufficiently relative to the pressure in outer chamber 50 to allow the valve 42 to move back to its normally open position. With the valve 42 now in its open position the pressurized air in the accumulator 34 can travel out the fuel inlet 30 into the combustion chamber 26 taking with it fuel received from the fuel metering system 20. At EC (exhaust 28 closed) the accumulator pressure stops falling and starts to increase due to compression of air in the combustion chamber 36 by upward movement of the head of the piston 14. This stops at point H when the head of the piston once again closes the fuel inlet 30. Points F and G can be adjusted by selecting different force springs for the spring 58 and/or changing the size of the restrictor 56.

As noted above, the fuel inlet 30 is located in the side wall of the cylinder 12. The fuel for a two-stroke engine comprises a fuel, such as gasoline, and a lubricant (oil). The longitudinal location or height of the inlet on the side wall has been selected to provide certain benefits. Proper location of the inlet 30 can allow for the advantage of eliminating the need for a separate lubrication system for the crankshaft and piston assembly in a system which nonetheless delivers the fuel to the combustion chamber above the piston without the fuel first going through the crankcase. In old style two-stroke systems fuel was passed through the crankcase so that oil in the fuel could lubricate the parts in the crankcase. Alternatively, a separate lubrication system would be needed. The present system uses the features of keeping the valve 42 in an open position while the piston 14 moves between just after an air inlet open position (IO) to top dead center (TDC) to provide lubrication for the parts in the crankcase and the piston. As the piston head passes the inlet 30 during this period, oil in the fuel from the outlet is sucked onto the side of the piston head and is transported by the piston head into the crankcase. Thus, unlike the old two-stroke system in which all the fuel passed through the crankcase, in the present system only a small amount of the fuel gets into the crankcase 18. However, this small amount nonetheless provides adequate lubrication. Apart from the cost savings from the fact that no separate lubrication system is needed, the present invention provides two other advantages. First, tolerances for the piston/cylinder fit can relaxed, but nonetheless not increase hydrocarbon emissions when compared to the old style fuel-through-crankcase system. In the old system, in order to meet governmental regulatory agency hydrocarbon emission standards, tolerances for piston/cylinder fit needed to be very fine in order to minimize or prevent fuel from seeping between the piston and cylinder during the downstroke of the piston (when the crankcase was being pressurized by the downstroke of the piston). However, with the present system, because fuel is not primarily being channeled through the crankcase 18, seeping of fuel between the piston and cylinder from the crankcase 18 is no longer a substantial factor on hydrocarbon emissions. Thus, piston/cylinder fit tolerances can be less precise. Manufacturing using larger tolerances results in a less expensive piston and cylinder manufacturing process. The second other advantage is reduced hydrocarbon emissions. Even with larger piston/cylinder fit tolerances, because fuel is not primarily being channeled through the crankcase 18, hydrocarbons do not substantially seep from the crankcase directly to the combustion chamber while the crankcase is being pressurized from the piston downstroke. The relatively small fuel that is transported from the inlet 30 to the side of the piston head and into the crankcase provides a relatively small hydrocarbon emissions problem.

Figure 6A:
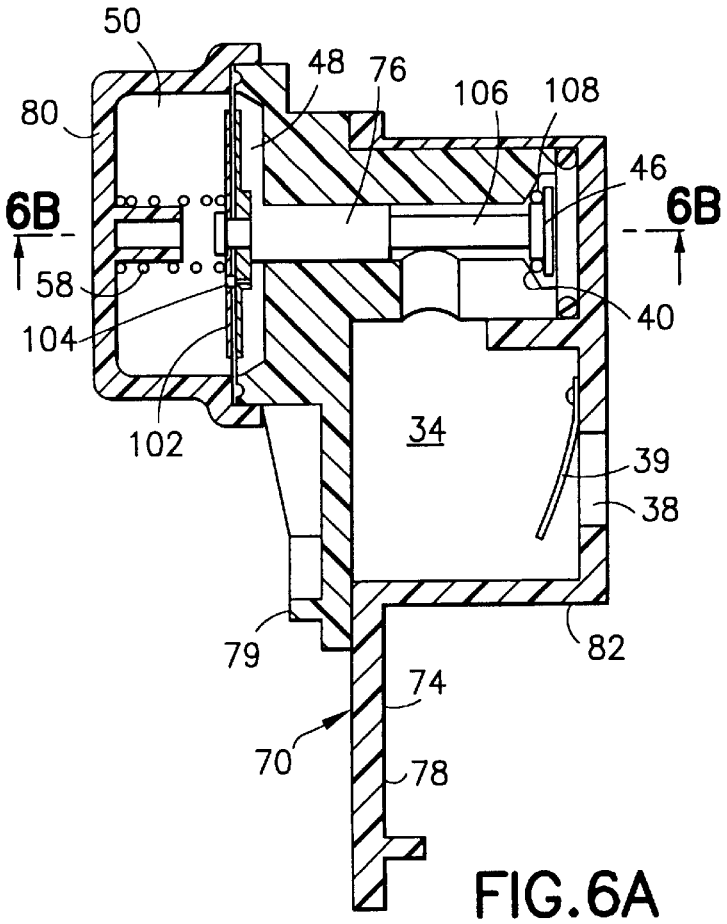
FIG. 6A is a cross-sectional view of a first unit of a fuel injection system incorporating features of the present invention.
Figure 6B:
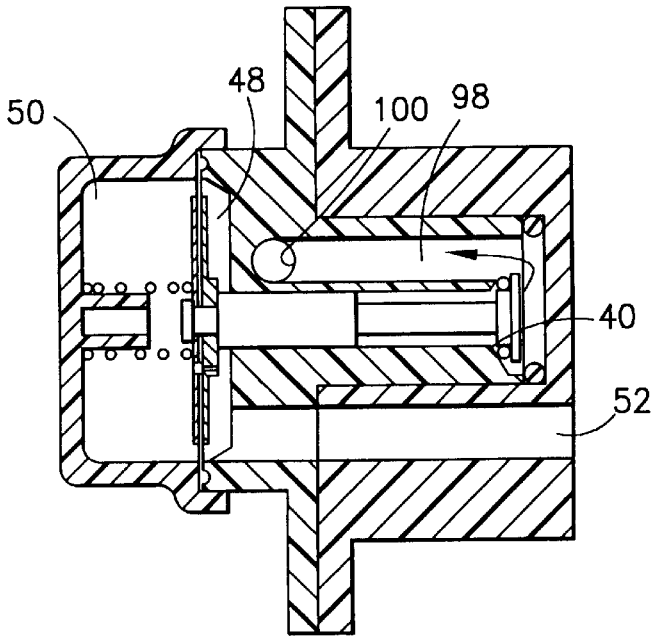
FIG. 6B is a cross-sectional view of the first unit shown in FIG. 6A taken along line 6B—6B.
Figure 6C:
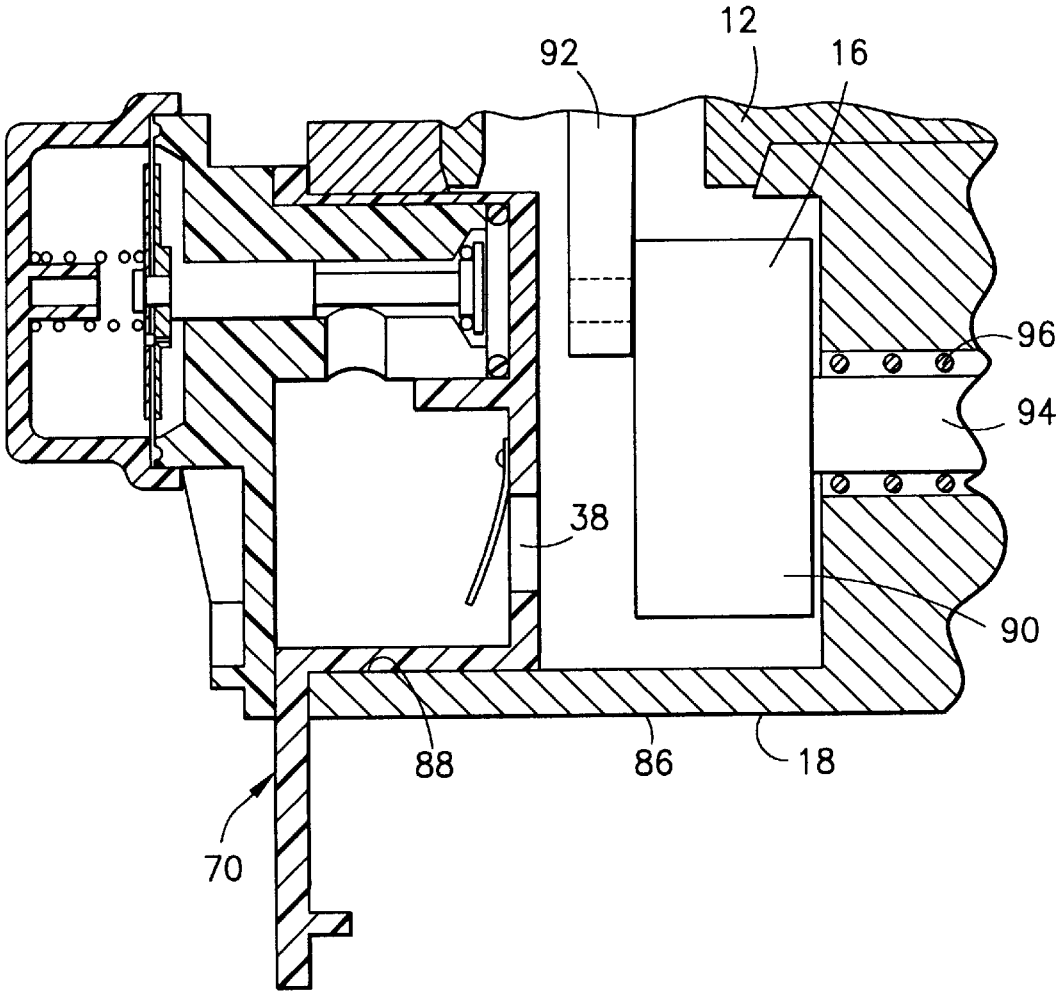
FIG. 6C is a cross-sectional view of the first unit shown in FIG. 6A shown attached to a crankcase piece of the engine.
Figure 7A:
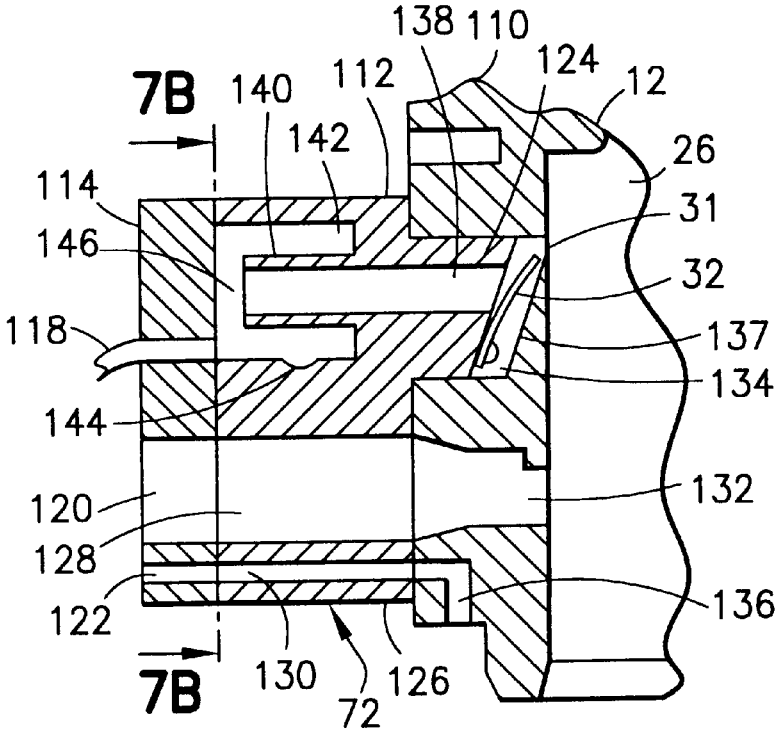
FIG. 7A is a cross-sectional view of a second unit of a fuel injection system, attached to a cylinder, for use with the first unit shown in FIGS. 6A and 6B.
Figure 7B:
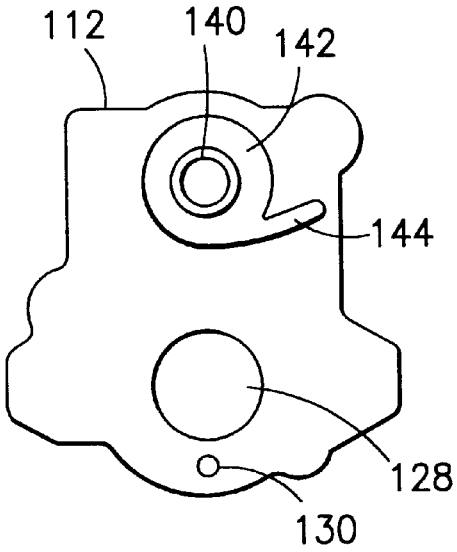
FIG. 7B is a cross-sectional view of the second unit shown in FIG. 7A taken along line 7B—7B.

Referring now to FIGS. 6A and 6B, a cross-sectional view of a first unit 70 of a specific embodiment of the general fuel injection system of FIG. 1 is shown. The first unit 70 is intended to be used with a second unit 72 of the system which is shown in FIGS. 7A and 7B. The first unit 70 generally comprises a housing 74 and a diaphragm and valve assembly 76. The housing 74 has three housing pieces 78, 79, 80 comprised of molded plastic. A first section 82 of the housing 74 has the inlet 38. Referring also to FIG. 6C, the first section 82 has an exterior shape that is sized and shaped to form part of the crankcase for the engine. More specifically, the engine has a crankcase piece 86 with end wall having an opening 88. In this engine the crankshaft 16 is a half-crank type crankshaft similar to that shown in U.S. Pat. No. 5,333,580 where the crankweight 90 is only on one side of the piston push rod 92. The shaft 94 of the crankshaft 16 is rotatably supported on the crankcase piece 86 by a bearing 96. The first section 82 fits inside the opening 88 to thereby seal off the opening. Thus, this eliminates the need for a separate end cap that was used in the opening in the prior art. The inlet 38 of the first unit housing 74 is, thus, located at the chamber formed by the crankcase 18. The housing need not function as part of the crankcase as an end cap, such as when the engine is a full crankweight engine having crankweights on both sides of the piston push rod.

The housing 74 forms the accumulator 34, the conduit 52, exit 40 from the accumulator, and, in combination with the diaphragm 102, the two diaphragm chambers 48, 50. The housing 74 has a channel 98 from the exit 40 to a tube mount exit 100 from the housing 74. The diaphragm 102 in this embodiment has a hole 104 therethrough that connects the two chambers 48, 50 to each other. The hole 104 functions as the flow restrictor 56. thereby eliminating the need for the channel 54. The valve 106 is preferably made of a lightweight material such as plastic with an O-ring seal 108. By using a lightweight material for the valve 106, valve float at high speed engine operation, such as 9000 RPM–15000 RPM, can be eliminated. Valve float is a condition that occurs when the weight or mass of the valve has an inertia that does not allow the valve to move fast enough to correspond to pressures in the diaphragm chambers. Thus, at such a high speed, a relatively heavy valve would remain in an open position (biased by the spring 58) and not close when it was designed to close. By making the valve 106 from a lightweight material, such as molded plastic, valve float can be eliminated. One of the reasons why molded plastic can be used is because the first unit 70 is connected to the crankcase 18 away from the cylinder 12. The cylinder 12 gets hot during engine operation. If the first unit 70 was connected to the cylinder, heat from the cylinder could melt the plastic valve 106. Thus, spacing the first unit 70 away from the cylinder 12 allows the valve 106 to be manufactured from lightweight plastic without risk of the valve melting and, without having to use a heavier material with a higher melting point that could cause valve float. The valve and the diaphragm can both be made of less expensive material than more expensive high temperature tolerant materials.

Figure 7C:
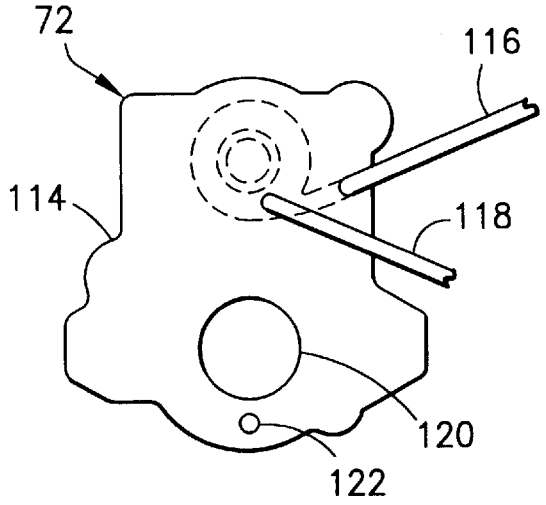
FIG. 7C is a front elevation view of the second unit shown in FIG. 7A.

Referring now to FIGS. 7A–7C, the second unit 72 is shown. The second unit 72 is preferably made of metal pieces and is attached directly to the side wall 110 of the cylinder 12. In this embodiment the second unit 72 has a reed valve 32 as in the embodiment shown in FIG. 1A. The second unit 72 has a first frame piece 112 and a second frame piece 114. A scavenged air tube 116 (see FIG. 7C) extends between the tube mount exit 100 of the first unit housing 74 (see FIG. 6B) to the second frame piece 114. The tube 116 functions as the conduit 60 shown in FIG. 1A. A fuel supply tube 118 extends from the fuel metering device to the second frame piece 114. The second frame piece 114 has mounting holes (not shown), air inlet hole 120, and air pulse hole 122. The first frame piece 112 also has mounting holes (not shown), a first section 124, and a second section 126. The second section 126 has an air inlet hole 128 and a pulse hole 130. The side wall 110 of the cylinder 12 has an air inlet hole 132, a positioning and fuel entry hole 134, and a pressure pulse hole 136. The first section 124 of the first frame piece 112 is located in the positioning and fuel entry hole 134. The positioning and fuel entry hole 134 has an upwardly sloped wall 137 that ends at a top hole that forms the air and fuel inlet 31. The front end of the first section 124 has an outward upward pitch. The first section 124 has a conduit 138 that opens into the hole 134 and is adapted to be closed by the reed valve 32. The conduit 138 connects with a tube section 140 in the second section 126. A swirl chamber 142 circumferentially surrounds the tube section 140 and has an entrance ramp 144. A gap 146 is provided between the end of the tube section 140 and the inner side of the second frame piece 114 for the fuel/air mixture to move from the swirl chamber 142 into the conduit 138. An end of the scavenged air tube 116 is located at the entrance ramp 144. An end of the fuel supply tube 118 is located at the swirl chamber 142. Thus, fuel is deposited in the swirl chamber 142 by the tube 118 and subsequently atomized and entrained with air from the tube 116 as the air swirls around the swirl chamber 142. The swirl chamber 142 allows the engine to be orientated at any position (even upsidedown) and still deliver a substantially uniform fuel/air mixture to the combustion chamber 26. However, in alternate embodiments other designs or configurations of the second unit 72 could be provided. In this embodiment the three air inlet holes 120, 128, 132 form the air inlet 24. The three pulse holes 122, 130, 136 form a conduit from the crankcase to the fuel metering device 20 to drive the device via crankcase pressure pulses. However, these holes 122, 130, 136 need not be provided if the fuel metering device is driven in another fashion or if a conduit separate from the second unit 72 is provided. By locating the two holes 132, 134 on the same side 110 of the cylinder 12, manufacturing the two holes can be accomplished relatively easily with a single die piece in the cylinder molding process such that location of the two holes relative to each other is relatively precise. However, the holes 132, 134 need not be on the same side and the first section 124 with its conduit 138 could be separate and spaced from a part having an air inlet hole.

Figure 8:
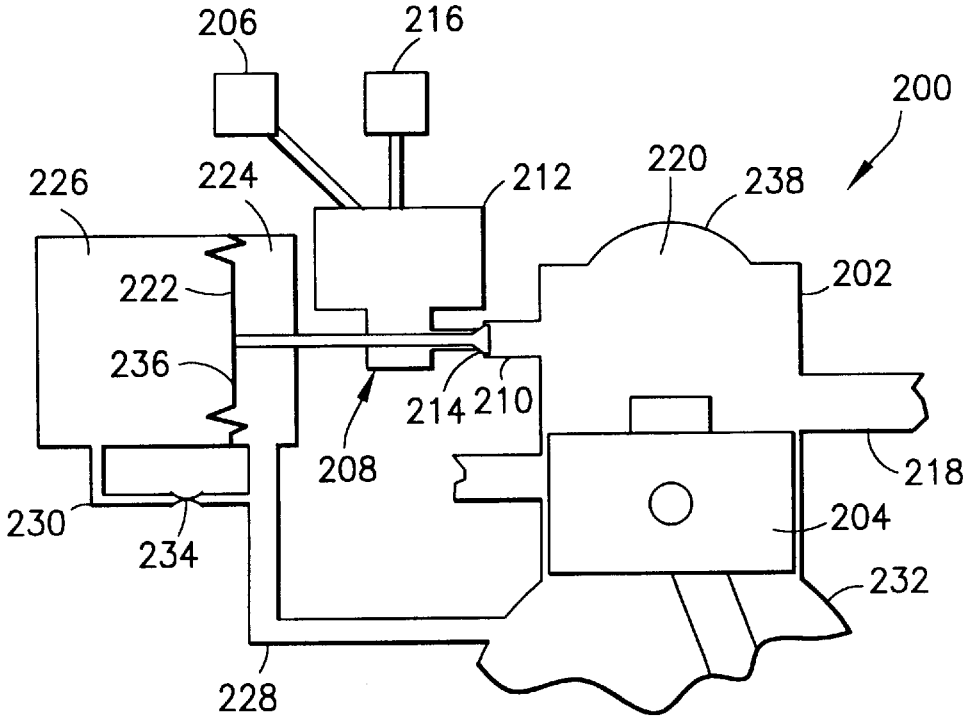
FIG. 8 is a partial schematic view of an alternate embodiment of an internal combustion engine incorporating features of the present invention.

Referring now to FIG. 8, a schematic view of an alternate embodiment of the present invention is shown. The engine 200 is similar to the engine 10 shown in FIG. 1. The engine 200 comprises a cylinder 202, a piston 204, a fuel metering system 206, and a fuel injection system 208. In this embodiment the fuel inlet 210 to the cylinder 202 is open for piston porting by the head of the piston 204, but it could have a flow check valve. The fuel metering system 206 could be any type of system. However, in this embodiment the fuel metering system 206 delivers fuel directly into the accumulator 212. The accumulator 212 has an exit 214 at the fuel inlet 210 and is connected to a source of compressed air 216. The source of compressed air 216 could be a conduit from the crankcase for obtaining scavenged air, a conduit from the exhaust 218 for obtaining expansion gases, a conduit from the combustion chamber 220 for obtaining compression gases as the piston 204 moves towards TDC, or an auxiliary compressed air source. The fuel from the fuel metering system 206 and the air from the compressed air source 216 are mixed into a fuel/air mixture at the accumulator 212. The fuel injection system 208 also comprises a diaphragm and valve assembly 222, an inner diaphragm pressure chamber 224, an outer diaphragm pressure chamber 226, two conduits 228, 230 from the crankcase 232, and a flow restrictor 234. In this embodiment the diaphragm 236 is not biased by a separate spring, but a biasing spring could be provided. Because the exit 214 from the accumulator 212 is located at the fuel inlet 210 to the cylinder 202, the accumulator 212 and diaphragm and valve assembly 222 are directly connected to the side of the cylinder 202 rather than at the crankcase 232. They could also be located at the top wall 238 of the cylinder. In addition, although the valve 240 has generally been illustrated as a rigid rod-like structure with a valve head, alternative valve structures could be used. Thus, the accumulator could be located at the cylinder, but the diaphragm could be located proximate the crankcase or otherwise spaced from the cylinder.

Figure 9:
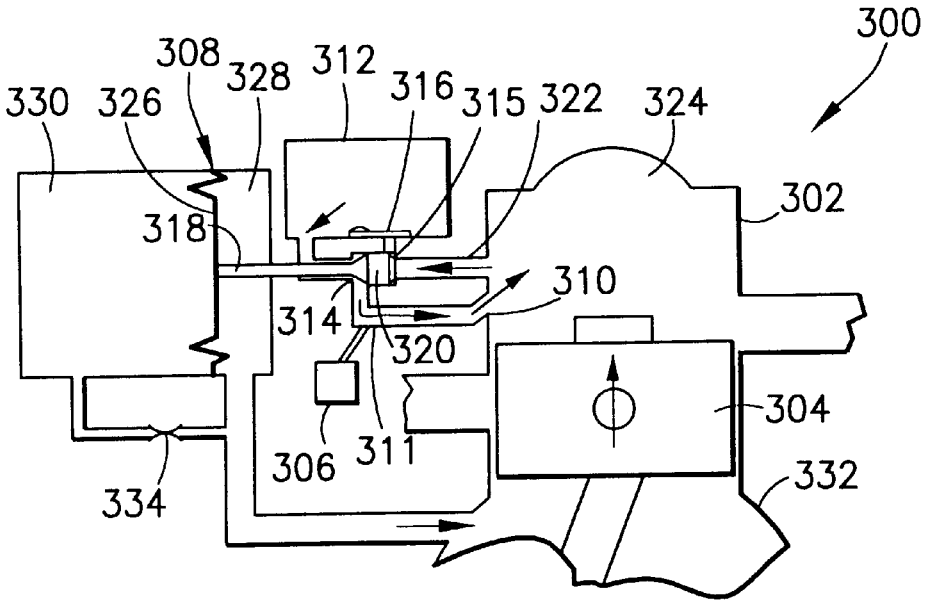
FIG. 9 is a partial schematic view of another alternate embodiment of an internal combustion engine incorporating features of the present invention.

Referring now to FIG. 9 a schematic view of another alternate embodiment will be described. In this embodiment the engine 300 is similar to the engine 200 shown in FIG. 8. The engine 300 comprises a cylinder 302, a piston 304, a fuel metering system 306, and a fuel injection system 308. In this embodiment the fuel inlet 310 to the cylinder 302 is open for piston porting by the head of the piston 304, but it could have a flow check valve. The fuel metering system 306 could be any type of system. However, in this embodiment the fuel metering system 306 delivers fuel directly into the fuel entry conduit 311 to the fuel inlet 310. The accumulator 312 has an exit 314 and an entrance 315. A reed valve 316 is connected to the accumulator 312 proximate the entrance 315. The valve 318 has a head 320 with a forward valve seating surface and a rearward valve seating surface. An intake conduit 322 extends from the cylinder 302 to a chamber in which the valve head 320 moves; proximate the entrance 315. The valve 318 is able to reciprocatingly move between two positions. In a rearward position of the valve the rearward valve seating surfaces seats against and seals the accumulator exit 314. Thus, air can pass through intake conduit 322, into the entrance 315, past the valve 316, and be stored in the accumulator 312. This stored air is compressed air from the up stroke of the piston 304. In a forward position of the valve 318 the forward valve seating surface seats against and seals the rear end of the intake conduit 322. The exit 314 from the accumulator is open in this forward valve position. Therefore, air from inside the accumulator 312 can travel out the exit 314, through the entry conduit 311, entrain fuel in the conduit 311, and exit the fuel inlet 310 into the combustion chamber 324. The valve 318 is driven between its forward and rearward sealing positions by the diaphragm 326 and pressures in the two diaphragm pressure chambers 328, 330. Both chambers 328, 330 are pressure loaded by pressure from the crankcase 332 with the outer chamber 330 being connected to the crankcase pressure by the flow restrictor 334. The diaphragm 326 and/or valve 318 may or may not be spring loaded in a forward or rearward position.

Figure 10:
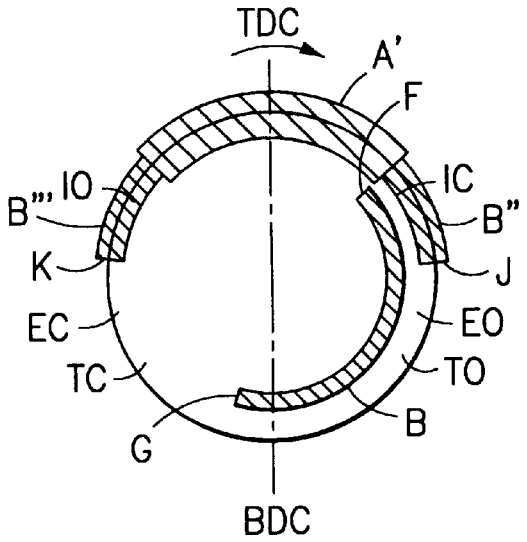
FIG. 10 is a diagram illustrating valve position and fuel inlet piston porting relative to piston location based upon crankshaft rotation for the engine shown in FIG. 9.
Figure 11A:
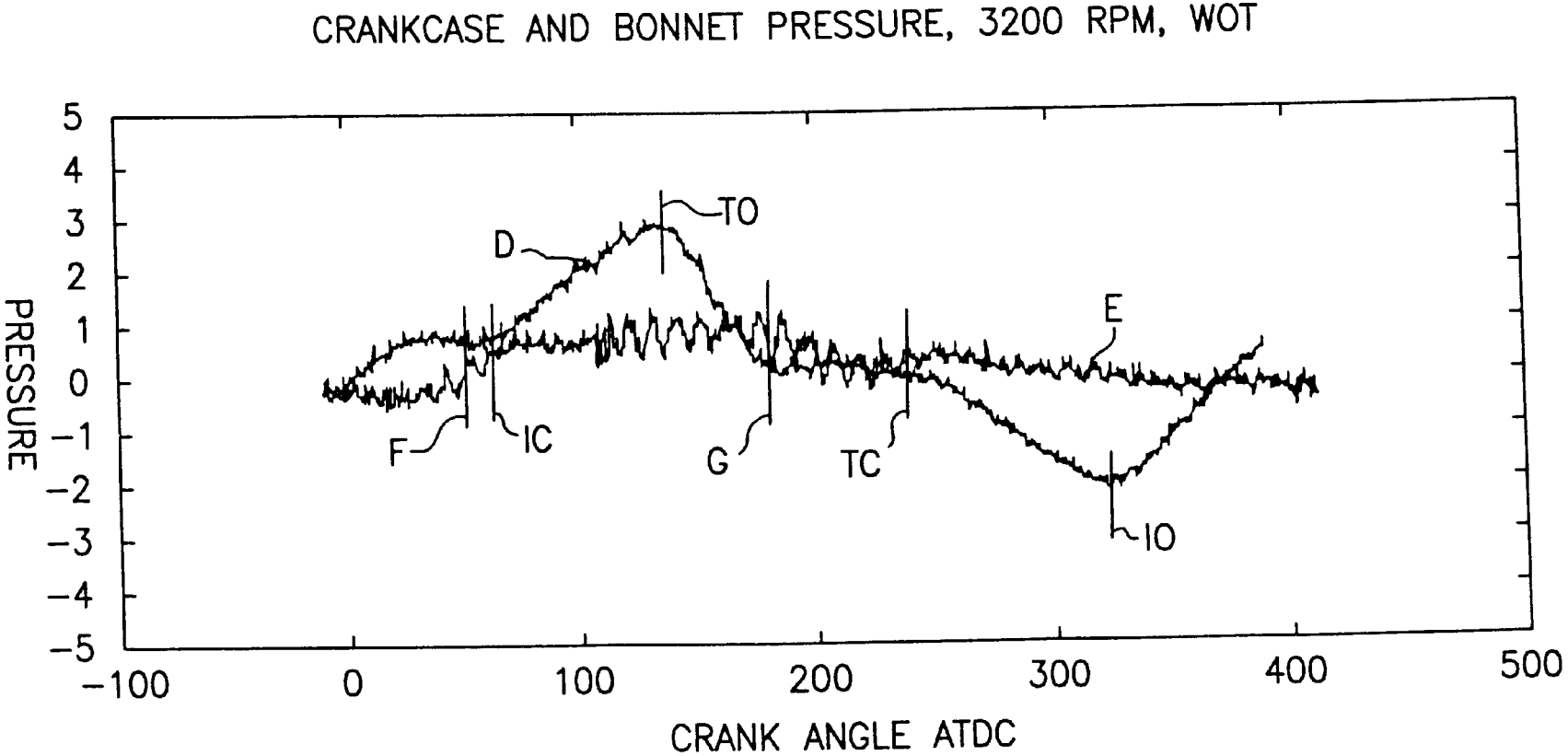
FIG. 11A is a graph of pressures in the two diaphragm pressure chambers shown in FIG. 9 at the first speed and wide open throttle.
Figure 11B:
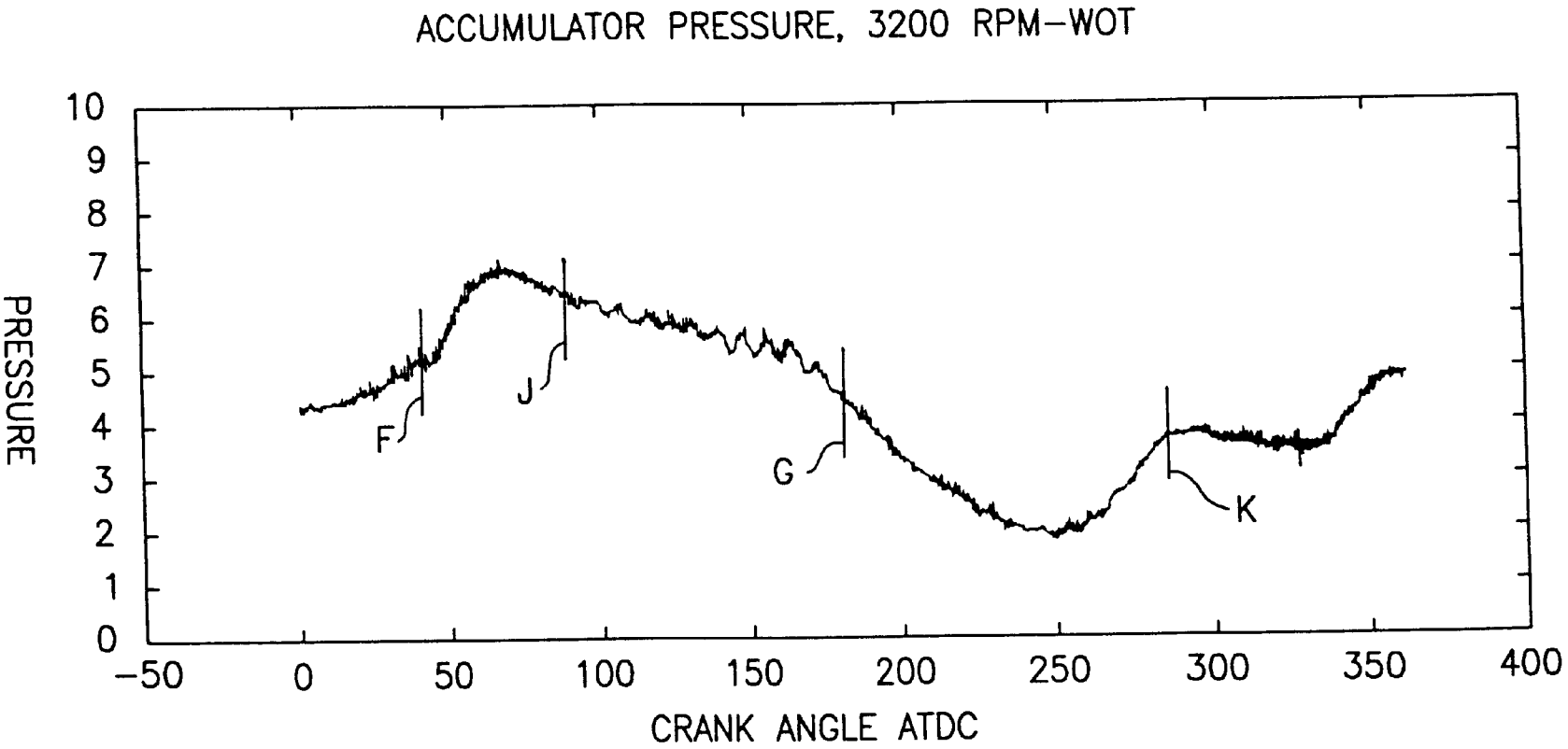
FIG. 11B is a graph of pressure in the accumulator shown in FIG. 9 at the first speed and wide open throttle.

Referring also to FIG. 10, similar to FIG. 2, movement of the valve 318 relative to other events during a single full piston cycle (which results from a 360° rotation of the crankshaft) will be described. FIG. 10 is intended to illustrate the line of events as a 360° chart corresponding to piston location as based upon angular position of the crankshaft 16 starting at TDC (0°) of the piston 14. At TDC the fuel inlet 310 is blocked by the side of the head of the piston 304. Area A' indicates when the piston head blocks the conduit 322. The piston head uncovers the conduit 322 about 45° of rotation of the crankshaft after TDC (ATDC). Because the intake conduit 322 is located above the fuel inlet 310, expansion gases from combustion push the valve 318 into its rearward position before the fuel inlet 310 is unblocked by the piston head. Area B" indicates when the valve 318 is at its rearward position because of expansion gases pressing against the front face of the valve. Referring also to FIGS. 11A and 11B, sample pressures from an engine running at 3200 RPM at wide open throttle are shown from angles ATDC. B in FIG. 10 indicates when, because of a pressure difference between pressures D and E in chambers 328 and 330, respectively, the valve 318 would be in its rearward position. Point F, movement of the valve 318 from its forward position to its rearward position can actually vary because, as indicated by B", the valve is kept rearward by expansion gases until point J which corresponds to open porting of the fuel inlet 310 with the combustion chamber by the piston head. With this embodiment pressure differences in the two chambers 328, 330 will cause the valve to move forward at point G and allow air in the accumulator to travel out the entry conduit 311. At point K the piston 304 closes the fuel inlet 310. Pressure from compression in the combustion chamber 324 by the piston 304 presses against the front end of the valve 318 and moves the valve to its rearward position at area B'". Thus, the combination of A', B" and B'" indicates when the fuel inlet 310 is blocked from the combustion chamber 324 by the piston 304. This embodiment illustrates that movement of the injection valve could be configured to move by more than just crankcase pressure. However, use of crankcase pressure to drive pressures in two opposite diaphragm pressure chambers in preferred.

The system as described above is generally intended for use with two-stroke engines having a low pressure fuel metering system, such as below 300 psi and preferably about 6 psi. A high pressure fuel metering system, on the other hand, would operate at pressures of about 3000 to 6000 psi. The pneumatically controlled compressed air assisted fuel injection system as described above (open ported) has been tested with a low pressure fuel metering system and, for an engine displacement size of 25 cc had operating hydrocarbon emissions less than 50 gm/bhp*hr (grams per brake horse power hour) and, more specifically, 39–43 gm/bhp*hr and 32.9–37.5 gm/bhp*hr at WOT.

In the system as described above an open cycle injection is used; i.e.: fuel injection when the exhaust and intake are both open. Injection of scavenged air occurs at the end of scavenging. A fresh air buffer is used in front of the fuel delivery; between TO and G. Unlike a SCIP system that would have early injection of fuel into the combustion chamber when a misfire occurs (and a resulting increase in hydrocarbon emissions), the system as described above would not have an early injection of fuel into the combustion chamber after a misfire. Crankcase pressure is used to both measure and drive the timing of the movement of the valve, but could be used for measurement only if a different drive system is provided. Crankcase pressure is used to control timing of fuel injection; not the fuel metering system. An averaged pressure from the crankcase pressure is used to render the valve movement timing independence of throttle condition.

Figure 12:
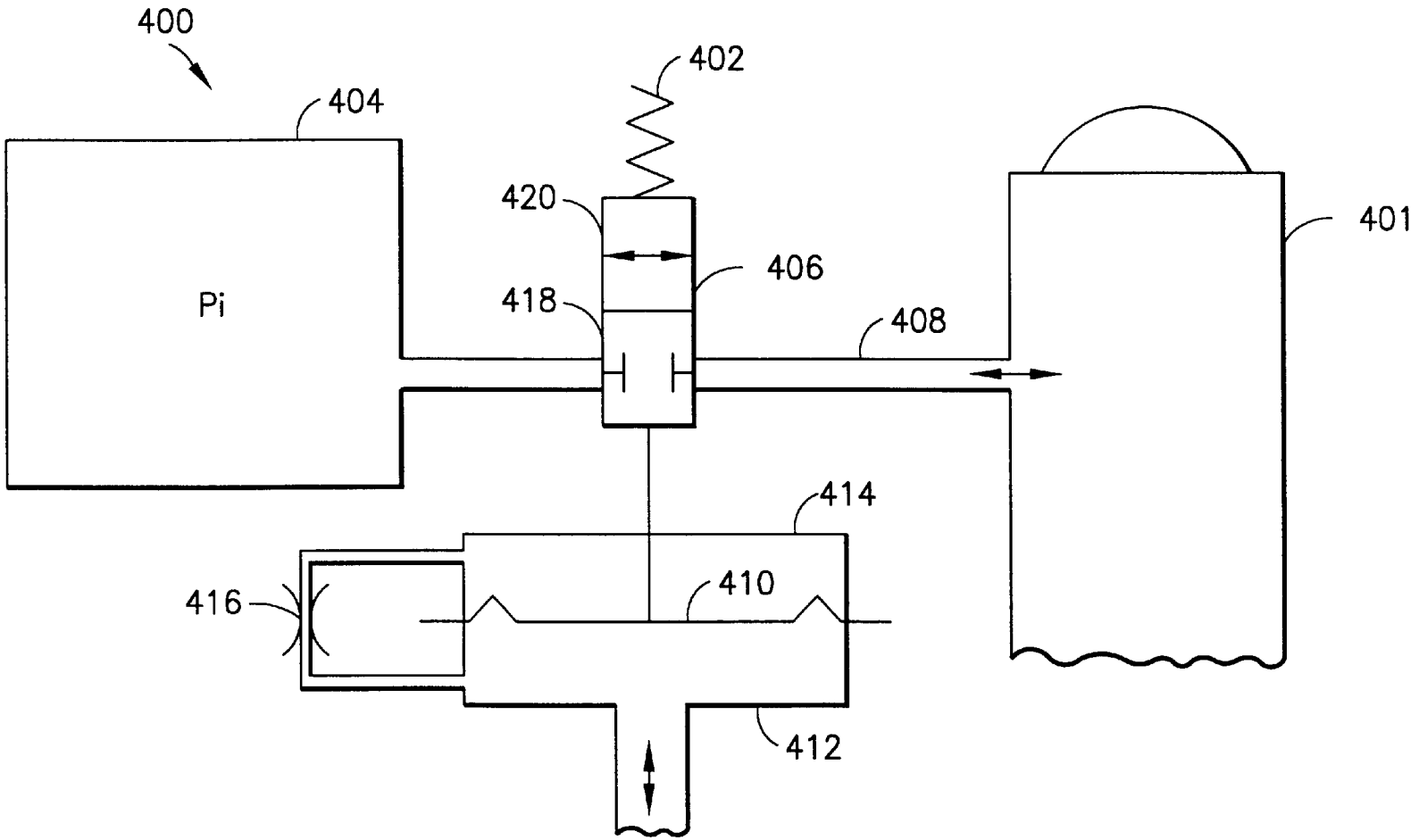
FIG. 12 is a schematic flow control diagram of an alternate embodiment of the present invention with cylinder charging.

FIG. 12 is a schematic diagram of a cylinder charged system 400 with a bias spring 402. The system 400 has an accumulator 404, a valve 406, a conduit 408, a diaphragm 410, two diaphragm chambers 412, 414 and a flow restrictor 416. The valve 406 has a first section 418 for closing the path through the conduit 408 and a second section 420 for opening the path. The spring 402 biases the valve 406 towards its open position. The conduit 408 extends between the accumulator 404 and the side wall of the cylinder 401. When the valve 406 is in its open position the accumulator 404 can either be charged to its injection pressure $P_i$, by expansion gases on a cylinder compression from the cylinder 401 or, alternatively, discharge its fuel/gas mixture into the combustion chamber of the cylinder 401. The valve 406 is moved by the spring 402 and the diaphragm 410. The outer chamber 412 receives pressure pulses from the crankcase. The crankcase pressure in the outer chamber 412 is attenuated and averaged into a relatively constant pressure in the inner chamber 414 by the restrictor 416 which varies slightly with engine operation conditions, based upon engine operation parameters such as speed and throttle position.

Figure 13:
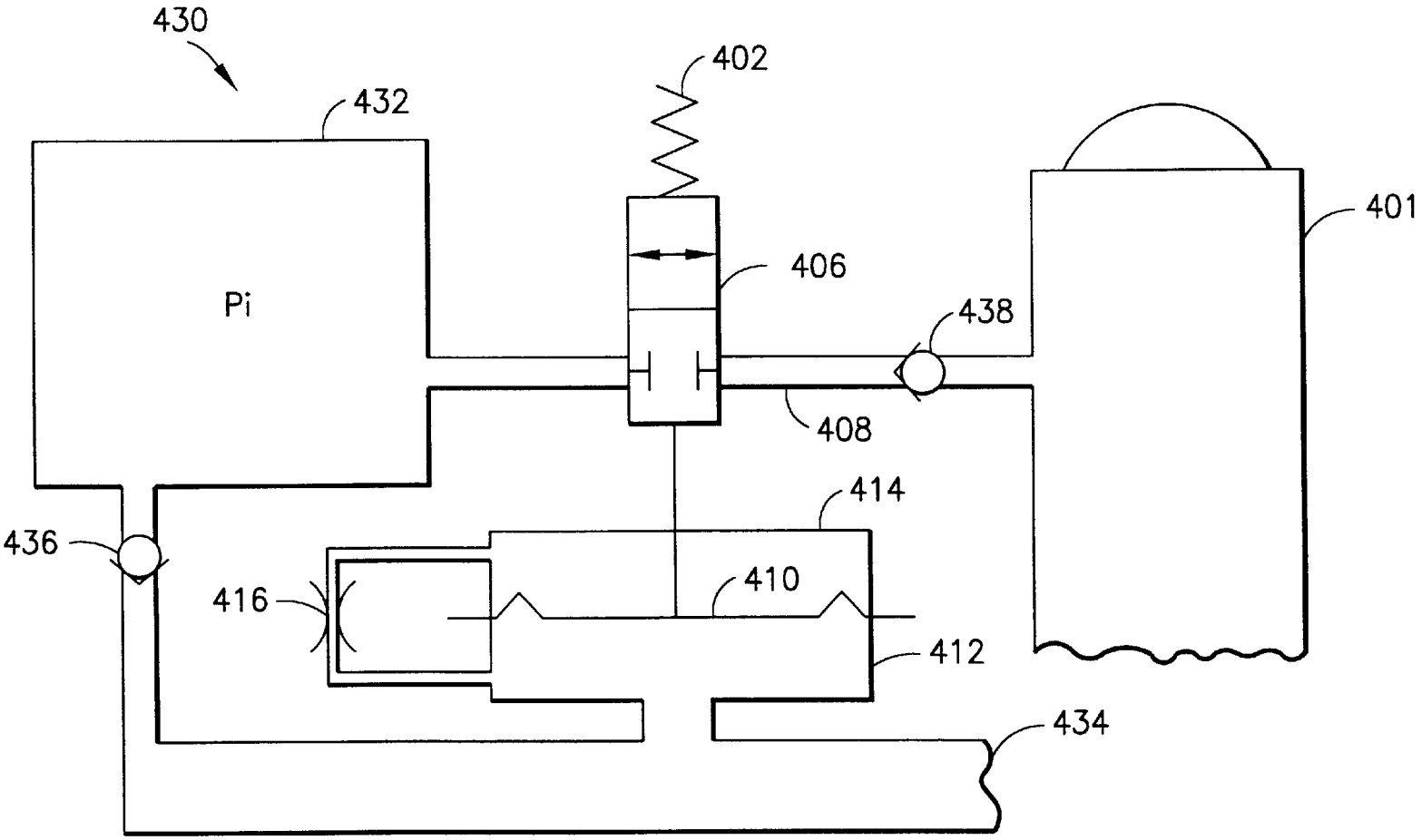
FIG. 13 is a schematic flow control diagram of an alternate embodiment of the present invention with crankcase charging.

FIG. 13 is a schematic diagram of a crankcase charged system 430. The system 430 has an accumulator 432, spring 402, valve 406, conduit 408, diaphragm 410, two diaphragm chambers 412, 414 and the flow restrictor 416. A conduit 434 is connected from the crankcase of the engine to the outer chamber 412 and the inlet to the accumulator 432. A check valve 436 is provided at the conduit 434 proximate the inlet to the accumulator 432. A second check valve 438 is provided at the conduit 408 proximate the inlet to the cylinder 401.

Figure 14:
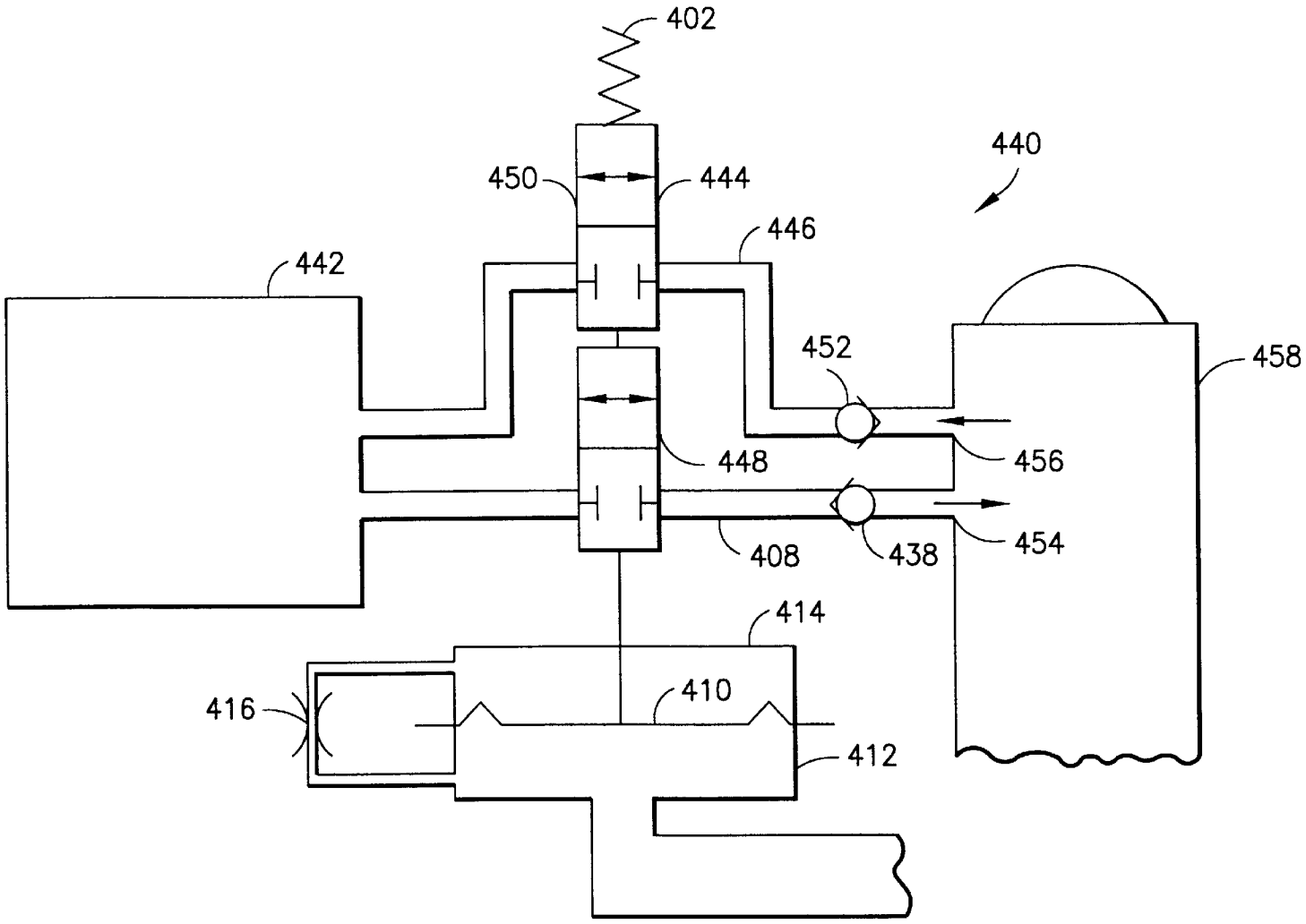
FIG. 14 is a schematic flow control diagram of an alternate embodiment of the present invention with cylinder charging on the compression stroke of the piston.

FIG. 14 is a schematic diagram of a cylinder charged system 440 which charges on the compression stroke of the piston and which has separate charge and injection paths. The system 440 has an accumulator 442, a valve 444, spring 402, conduit 408, diaphragm 410, two diaphragm chambers 412, 414, flow restrictor 416, and conduit 446. The valve 444 has two 448, 450 open and closed valve sections that are aligned with the two conduits 408, 446, respectively. Both sections 448, 450 are either at an open position at the same time or at a closed position at the same time. Check valves 438, 452 help to control flow bet ween the injection port 454 a nd charging port 456 in the side wall of the cylinder 458.

Figure 15:
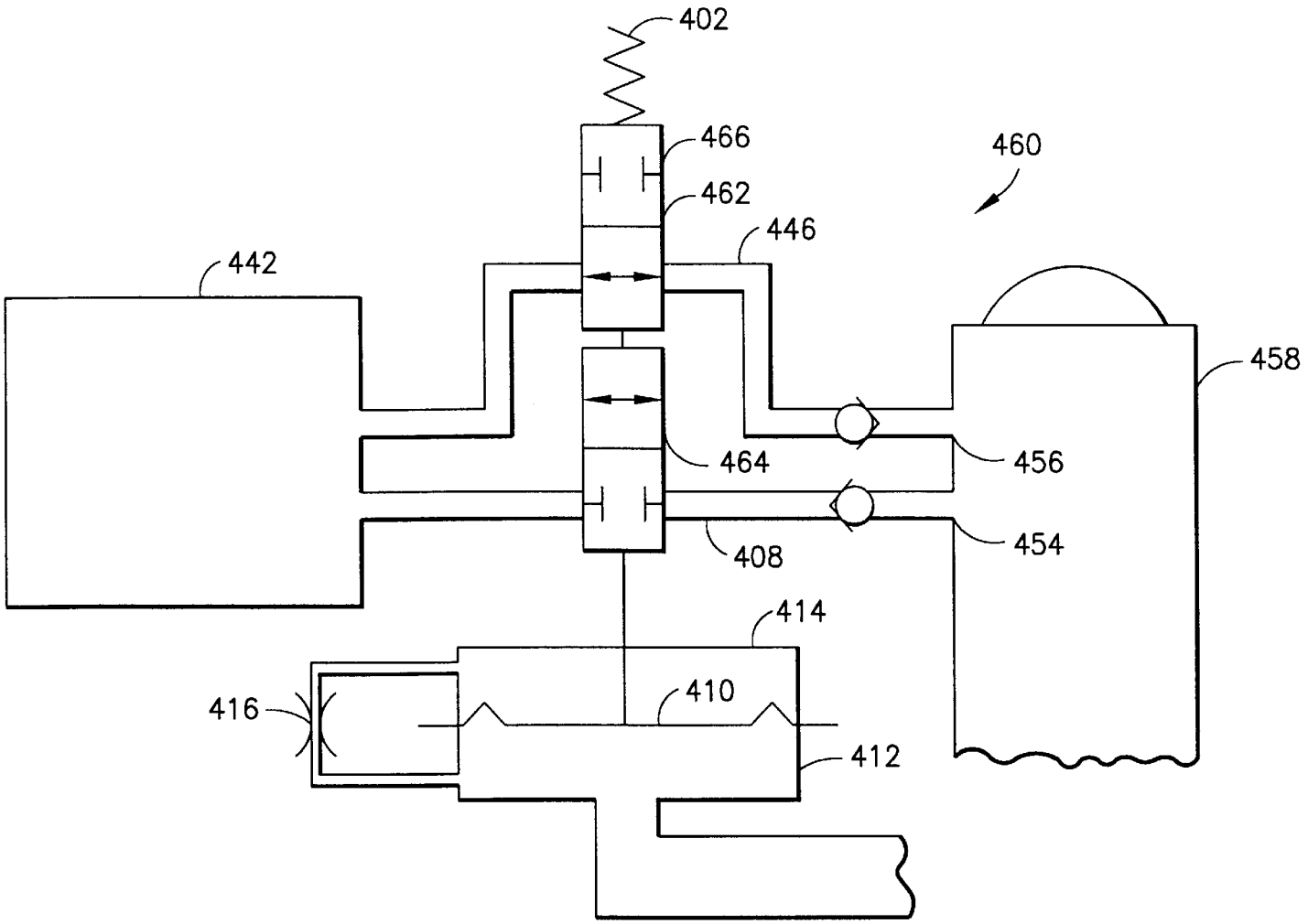
FIG. 15 is a schematic flow control diagram of an alternate embodiment of the present invention with cylinder charging on the expansion stroke of the piston.

FIG. 15 is a schematic diagram of a cylinder charged system 460 similar to system 440, but which charges on the expansion stroke of the piston rather than on the compression stroke. The valve 462 is configured such that the two sections 464, 466 are alternatively at opened or closed positions.

Figure 16:
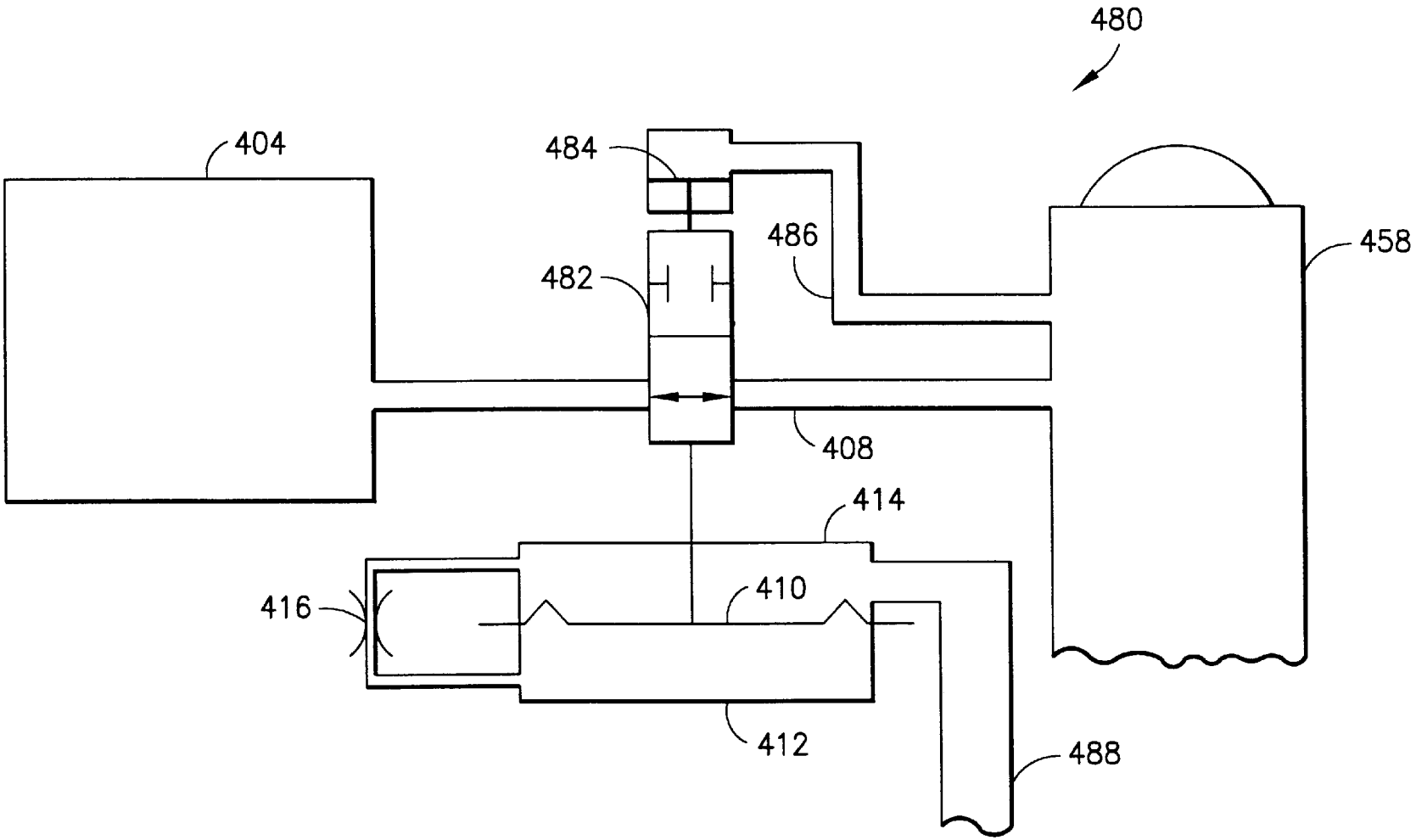
FIG. 16 is a schematic flow control diagram of an alternate embodiment of the present invention with an expansion closer system to close the injection valve earlier.

FIG. 16 is a schematic diagram of a cylinder charged system 480 with an expansion closer mechanism to close the valve early. The system 480 has the accumulator 404, a valve 482, conduit 408, diaphragm 410, diaphragm chambers 412, 414 and flow restrictor 416. The valve 482 has an end 484 that is in communication with conduit 486. Expansion gases from combustion can pass through the conduit 486 to press against the end 484 and move the valve 482 to its closed position. The end 484 may comprise a second diaphragm which forms a seal that separates combustion gases in conduit 486 from a fuel and air mixture in conduit 408 intended to be injected into the cylinder. In this embodiment inner chamber 414 is connected by a conduit 488 to crankcase pressure. This type of embodiment causes earlier closure of the valve 482, but does not effect the timing of opening of the valve.

Figure 17:
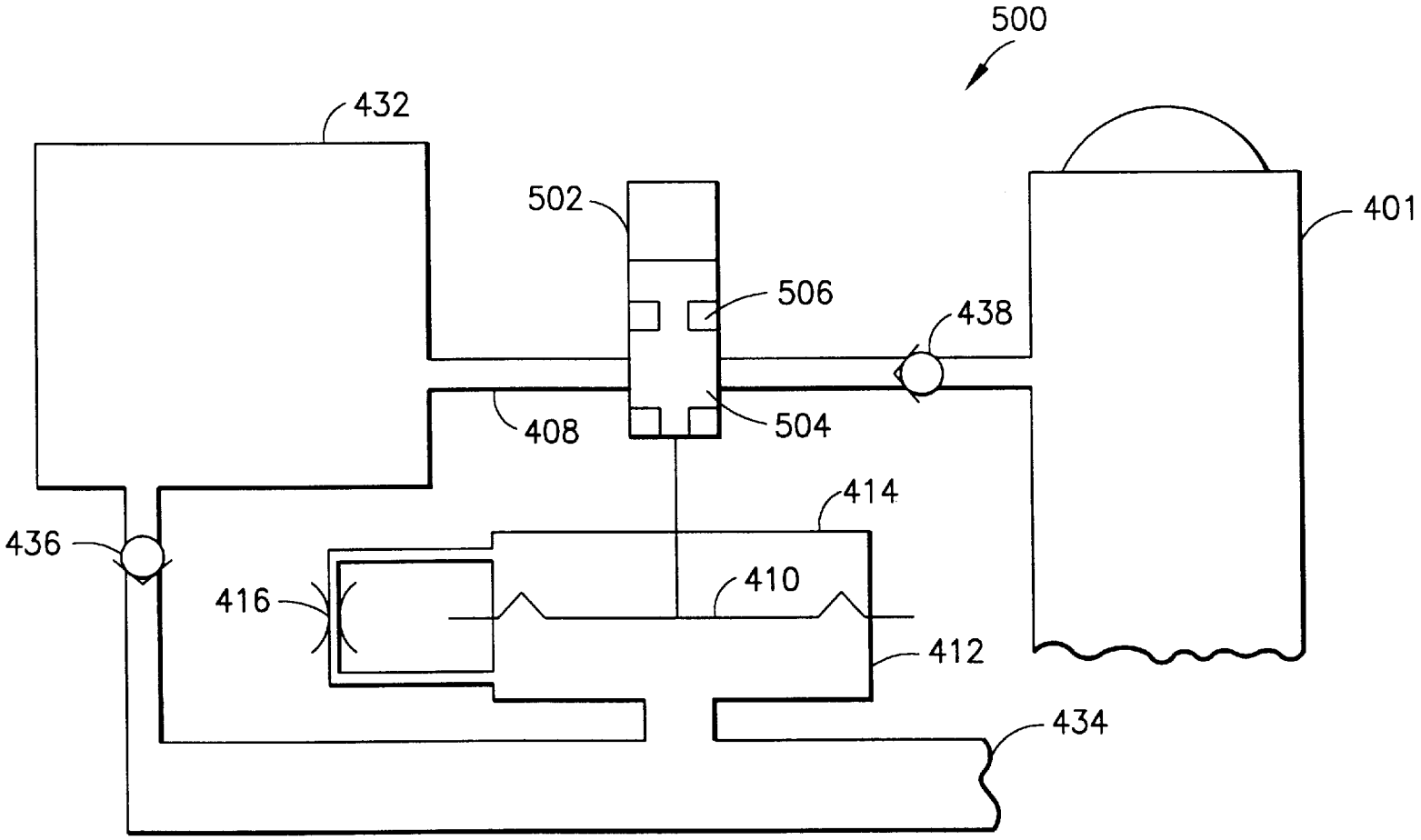
FIG. 17 is a schematic flow control diagram of a system as in FIG. 13 with a spool valve.

FIG. 17 is a schematic diagram of a system 500 similar to the system 430 shown in FIG. 13. In this embodiment the valve 502 is a spool valve with a closure section 504 and valve injection pressure has no effect on timing of movement of the valve 502.

Figure 18:
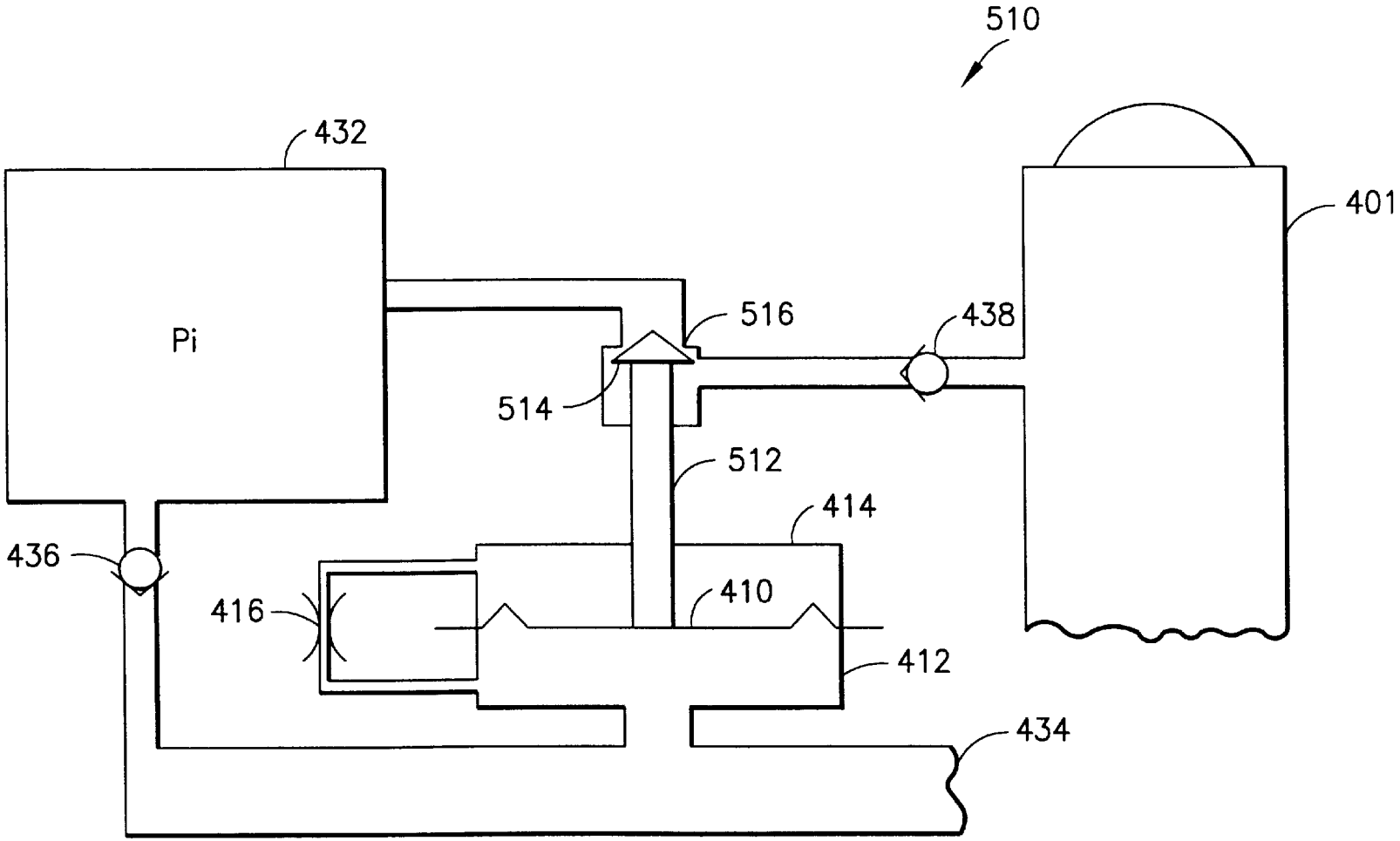
FIG. 18 is a schematic flow control diagram of a system as in FIG. 13 with a poppet valve.

FIG. 18 is a schematic diagram of a system 510 similar to the system 430 shown in FIG. 13. In this embodiment the valve 512 is a poppet valve. The area at the base 514 of the valve head is greater than the diameter of the conduit aperture 516. Injection pressure $P_i$ in the accumulator 432 has an effect on timing of movement of the valve 512, but this effect is minimal.

Figure 19:
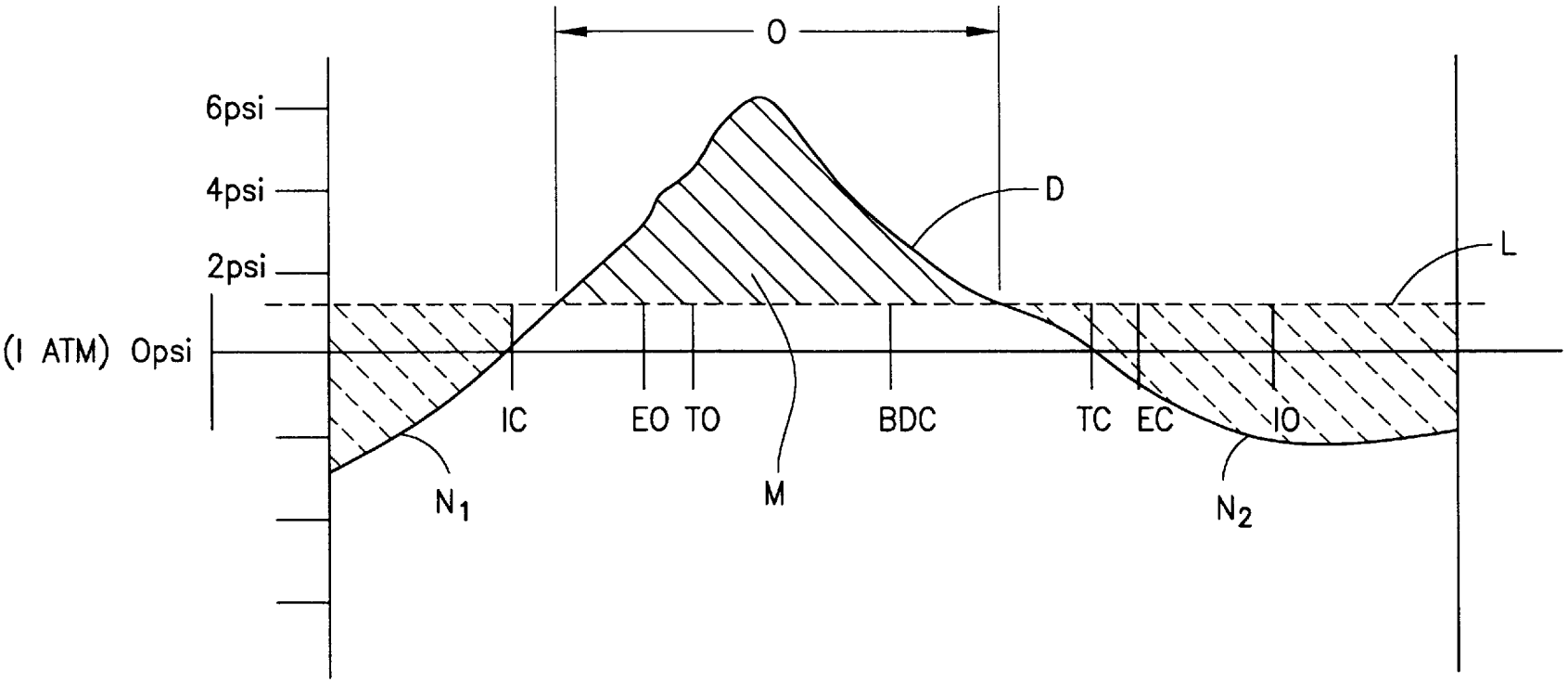
FIG. 19 is a graph of crankcase pressure and average crankcase pressure for a full cycle of a piston.
Figure 20:
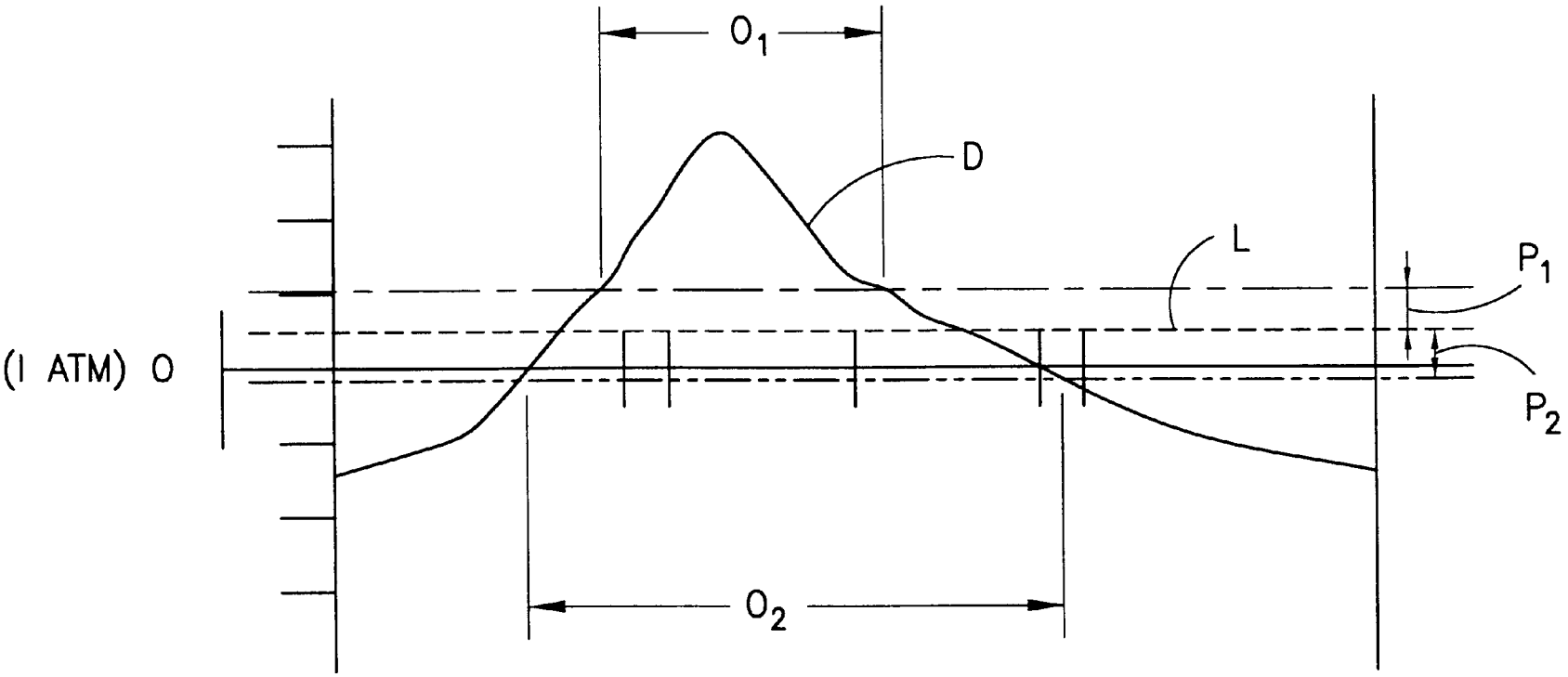
FIG. 20 is a graph as in FIG. 19 showing effects of opening bias and closing bias on valve movement timing.

FIG. 19 is a schematic graph of crankcase pressure similar to FIG. 3A with an engine at wide open throttle and having reed valve induction. The dashed horizontal line L is the average crankcase pressure for a single full piston cycle. Area M above line L is representative of differential pressure between the average crankcase pressure L and the actual crankcase pressure D available to hold the injection valve closed. Areas $N_1$ and $N_2$ below line L are representative of differential pressure available to hold the injection valve open. Referring also to FIG. 20, the effect of a biasing force, such as by a spring, on the injection valve can be seen. In FIG. 19 "O" is representative of when the valve is closed; i.e., when the crankcase pressure D is above the average pressure L. In FIG. 20 $O_1$ is representative of when the injection valve is closed with a system that has an additional opening bias. $O_2$ is representative of when the injection valve is closed with a system that uses an additional closing bias. The opening bias $P_1$ and closing bias $P_2$ are effective bias pressures and, for a biasing spring and diaphragm embodiment, would be the force of the spring divided by the area of the diaphragm.

Figure 21A:
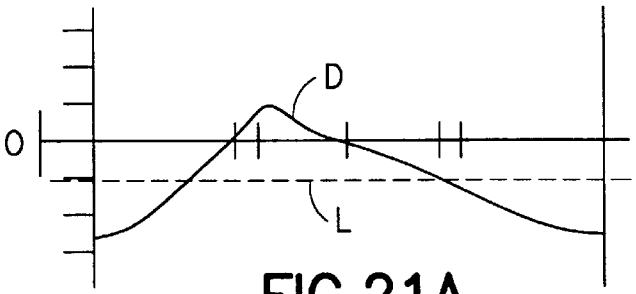
FIGS. 21A, 21B, and 21C are graphs as in FIG. 19 for a system with read valve induction at idle throttle, half throttle and wide open throttle positions, respectively.
Figure 21B:
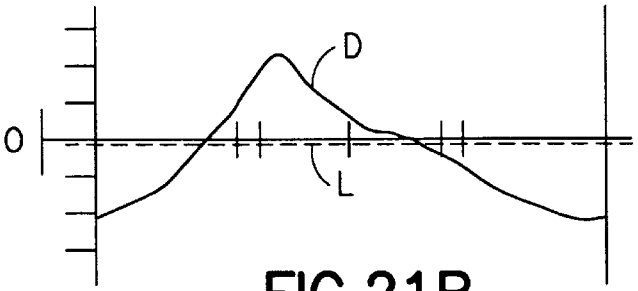
Figure 21C:
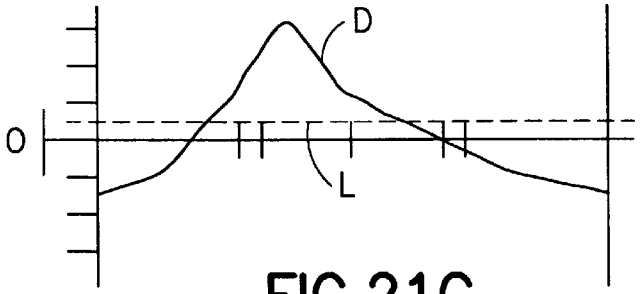
Figure 22A:
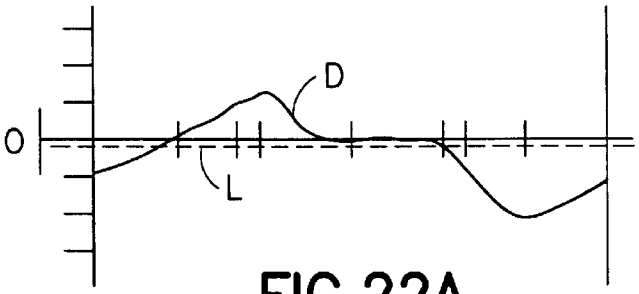
FIGS. 22A, 22B and 22C are graphs as in FIG. 19 for a system with piston port induction at idle throttle, half throttle and wide open throttle positions, respectively.
Figure 22B:
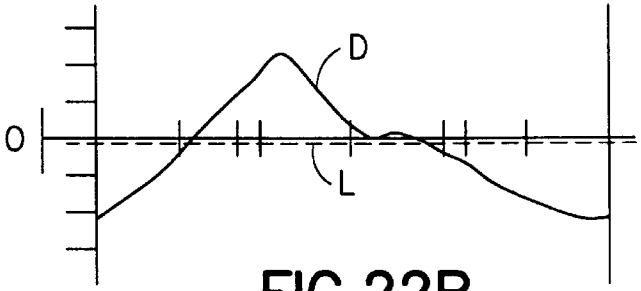
Figure 22C:
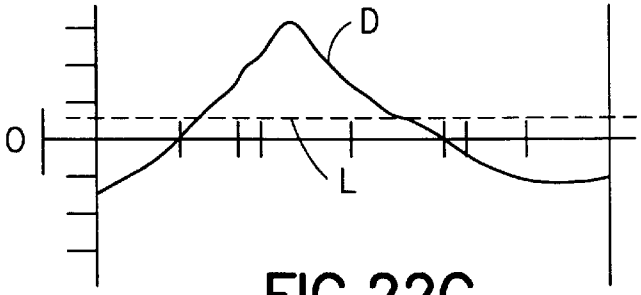

FIGS. 21A, 21B, 21C represent crankcase pressure D and average crankcase pressure L for a reed valve induction system at idle throttle, half throttle and wide open throttle, respectively. The average crankcase pressure L increases with throttle position and speed of the engine. The same is true for a piston port induction system as seen in FIGS. 22A, 22B and 22C, respectively, but to a lesser extent.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an internal combustion engine having a pneumatically controlled compressed air assisted fuel injection system with a valve connected to a diaphragm, wherein the improvement comprises:

two diaphragm chambers, located on opposite sides of the diaphragm, both connected to pressure from a crankcase of the engine, a second one of the diaphragm chambers being connected to the crankcase pressure through a flow restrictor, wherein the flow restrictor is always open and comprises a cross-sectionally narrowed flow path section to delay the flow of gases therethrough, and wherein pressure in the second diaphragm chamber is an attenuated averaged pressure relative to the crankcase pressure.

2. An engine as in claim 1 wherein the attenuated averaged pressure in the second diaphragm chamber is phase shifted relative to the crankcase pressure.

3. An engine as in claim 1 wherein crankcase pressure varies during a single cycle of the engine between about 3 psi above and below atmospheric pressure and the attenuated averaged pressure varies between about 1 psi above and below atmospheric pressure.

4. An engine as in claim 1 wherein the flow restrictor is sized and shaped to provide the pressure in the second diaphragm chamber with a minimum attenuation of about one-third of the crankcase pressure.

5. An engine as in claim 1 further comprising a spring biasing the valve towards an open position.

6. An engine as in claim 5 wherein the injection system comprises means for keeping the valve in the open position during a period of time corresponding to about 270° of rotation of a crankshaft of the engine.

7. An engine as in claim 1 wherein the injection system comprises means for allowing the valve to move from a closed position to an open position only upon a sensed crankcase pressure indicating a substantial completion of crankcase blowdown.

8. An engine as in claim 1 wherein the second diaphragm chamber is in constant, uninterrupted communication with the crankcase pressure through the flow restrictor.

9. A method of determining timing of movement of a valve in a pneumatically controlled compressed air assisted fuel injection system for an internal combustion engine comprising steps of:

sensing pressure inside a crankcase of the engine;

determining when crankcase blowdown has substantially completed based upon the sensed pressure inside the crankcase; and allowing movement of the valve to an open position only after substantial completion of crankcase blowdown has been determined, wherein the step of sensing pressure comprises transmitting the crankcase pressure to a first diaphragm chamber against a first side of the diaphragm, transmitting the crankcase pressure to a restrictor, and exerting an attenuated, averaged pressure of the crankcase pressure against a second opposite side of the diaphragm.

10. A method as in claim 9 wherein the step of determining when crankcase blowdown has substantially completed comprises movement of the diaphragm in a direction forward into the first diaphragm chamber.

11. A method as in claim 9 further comprising biasing the valve by a spring towards the open position.

12. A method as in claim 9 wherein the step of allowing movement of the valve to the open position includes use of a relatively constant force which varies slightly with engine operation conditions and resisting movement of the valve to the open position by force from the crankcase pressure.

13. A method as in claim 12 wherein the relatively constant force is varied based upon at least one engine operation parameter.

14. A method as in claim 13 wherein the at least one engine operation parameter is speed of the engine.

15. A method as in claim 13 wherein the at least one engine operation parameter is a throttle position of a throttle of the engine.

16. A method as in claim 13 wherein the relatively constant force renders timing of the valve being located at the open position relatively independent of the at least one engine operating parameter.

17. A method as in claim 13 wherein the relatively constant force is derived from an averaged attenuation of the crankcase pressure.

18. A method as in claim 17 wherein the averaged attenuated crankcase pressure is derived from a flow restriction of crankcase pressure waves.

19. A method as in claim 13 wherein the relatively constant force is derived from a varying spring force.

20. A method as in claim 13 wherein the relatively constant force is combined with a constant force used for biasing the valve and thereby affect its movement timing.

21. A method as in claim 20 wherein the constant force is provided by a bias spring.

22. A method as in claim 20 wherein the constant force and the relatively constant force are derived from a same mechanism.

23. A method as in claim 9 wherein the step of sensing pressure inside the crankcase comprises electronically measuring the crankcase pressure and averaging at least a portion of the electronic measurement.

24. A method of moving a valve in an internal combustion engine pneumatically controlled compressed air assisted fuel injection system comprising steps of:

determining timing of movement of the valve comprising steps of:

sensing pressure inside a crankcase of the engine;

determining when crankcase blowdown has substantially completed based upon the sensed pressure inside the crankcase; and moving the valve to an open position only after substantial completion of crankcase blowdown has been determined.

25. A method as in claim 24 wherein the step of moving the valve to the open position comprises biasing the valve by a spring towards the open position.

26. A method as in claim 24 wherein the step of moving the valve occurs when the crankcase pressure in the first diaphragm chamber is less than the attenuated pressure.

27. A method as in claim 26 further comprising maintaining the valve in the open position during an engine crankshaft rotation of between about 220° and about 270°.

28. In a two-stroke internal combustion engine having a pneumatically controlled compressed air assisted fuel injection system, the injection system having a source of compressed air and a valve connected to an exit from the source of compressed air, wherein the improvement comprises:

means for maintaining the valve in an open position during a rotation of a crankshaft of the engine of about 270° to about 220°, the means for maintaining comprising a first pressure chamber connected between the valve and the source of compressed air and a second pressure chamber connected between the valve and the source of compressed air by a flow restrictor, the restrictor having a narrowed flow path adapted to delay the flow of air through the flow restrictor.

29. An engine as in claim 28 wherein the means for maintaining the valve in the open position includes a spring biasing the valve towards the open position.

30. An engine as in claim 28 wherein the valve opens and closes only once during a full rotation cycle of the crankshaft.

31. A two-stroke internal combustion engine comprising an engine displacement size between about 16 cc to about 38 cc, a low pressure fuel metering system, and a pneumatically controlled compressed air assisted fuel injection system connecting the fuel metering system to a cylinder of the engine, wherein the injection system is adapted to inject air and fuel at a timing such that operating hydrocarbon emissions from the engine are less than 50 gm/bhp*hr.

32. An engine as in claim 31 wherein the injection system has a valve with an open ported exit into a cylinder of the engine.

33. An engine as in claim 31 wherein the injection system has a main valve into an exit channel and a check valve at an end of the exit channel into a cylinder of the engine thereby forming a closed ported exit for the injection system.

34. In an internal combustion engine having a pneumatically controlled compressed air assisted fuel injection system with a valve connected to a diaphragm across a first diaphragm pressure chamber, wherein the improvement comprises:

the first diaphragm pressure chamber being in communication with a crankcase of the engine such that crankcase pressure is provided in the diaphragm pressure chamber, wherein the pressure in the diaphragm pressure chamber both pushes on the diaphragm to locate the valve at a closed position and pulls on the diaphragm to locate the valve at an open position as crankcase pressure varies, wherein the injection system further comprises a second diaphragm pressure chamber located on an opposite side of the diaphragm from the first diaphragm pressure chamber, and wherein the second diaphragm pressure chamber is in communication with the crankcase pressure through a flow restrictor channel.

35. An engine as in claim 34 wherein the injection system further comprises a spring biasing the valve towards the open position.

36. An engine as in claim 34 wherein the injection system further comprises a conduiting path from the valve to a combustion chamber of a cylinder of the engine, and wherein a check valve is located at an exit of the conduit path into the combustion chamber.

37. An engine as in claim 34 wherein the injection system further comprises an accumulator with an entrance in communication with the crankcase pressure and having a flow check valve at the entrance and an exit which is opened and closed by the valve.

38. In an internal combustion engine having a pneumatically controlled compressed air assisted fuel injection system with a valve connected to a diaphragm and two diaphragm chambers on opposite sides of the diaphragm, wherein the improvement comprises:

the diaphragm chambers being connected to at least one location of the engine that generates varying gas pressures substantially separate and independent of combustion expansion gases from combustion in an individual piston cycle, wherein the at least one location for both diaphragm chambers is a crankcase of the engine, and wherein one of the diaphragm chambers is in communication with gas pressure in the crankcase through a continuously open flow restrictor channel.

39. An engine as in claim 38 wherein the at least one location for both diaphragm chambers is a crankcase of the engine, and wherein one of the diaphragm chambers is in communication with gas pressure in the crankcase through a flow restrictor channel.

40. An engine as in claim 37 wherein the injection system further comprises a spring biasing the valve towards an open position.

41. In an internal combustion engine having a pneumatically controlled air assisted fuel injection system with a valve connected to a diaphragm, wherein the improvement comprises:

a charging path through a cylinder wall that is positioned such that closure of a charging port of the charging path at the cylinder wall by a piston of the engine determines a level of compression derived from a cylinder compression or expansion stroke to be used for fuel injection on a next cycle of the piston.

42. An engine as in claim 41 further comprising a check valve located at the charging port to prevent discharge of an injection charge through the port.

43. An engine as in claim 41 wherein the injection system further comprises an injection port which is separate and independent from the charging port and which is controlled by a pneumatic injection control valve.

44. An engine as in claim 42 wherein the injection port is located through the cylinder wall.

45. An engine as in claim 42 further comprising a check valve located at the injection port to prevent charging of the injection system through the injection port.

46. In an internal combustion engine having a pneumatically controlled compressed air assisted fuel injection system with a valve connected to a diaphragm, wherein the improvement comprises:

locating an injection port on a wall of a cylinder of the engine below 45 degrees after top dead center of a piston in the cylinder such that the injection system is shielded from high combustion temperatures and pressures by the piston and wherein the injection port is located to provide a limited additional flow of fuel and oil onto a skirt of the piston to thereby provide lubrication to the cylinder and piston and, by piston action, to components in a crankcase of the engine.

* * * * *